US006305788B1

(12) United States Patent
Silverbrook

(10) Patent No.: US 6,305,788 B1
(45) Date of Patent: Oct. 23, 2001

(54) LIQUID EJECTION DEVICE

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/505,010

(22) Filed: Feb. 15, 2000

(30) Foreign Application Priority Data

Feb. 15, 1999 (AU) ..... PP8691

(51) Int. Cl.[7] ..... B41J 2/04; B41J 2/015; B41J 2/135

(52) U.S. Cl. ..... 347/54; 347/20; 347/44

(58) Field of Search ..... 347/20, 54, 63, 347/65, 67, 44

(56) References Cited

U.S. PATENT DOCUMENTS 5,278,585 * 1/1994 Karz et al. ..... 347/65

5,838,351 * 11/1998 Weber ..... 347/85

* cited by examiner

*Primary Examiner*—John Barlow
*Assistant Examiner*—Juanita Stephens

(57) ABSTRACT

A liquid ejection device comprising a nozzle chamber, an ejection paddle located within the nozzle chamber for ejecting liquid from the nozzle chamber though an aperture in one wall of the nozzle chamber when the paddle is moved from a first state into an ejection state, a liquid supply port arranged in a manner such that it is substantially closed by the paddle when the paddle is in the first state, and wherein the nozzle chamber comprises an internal protrusion on a wall structure thereof which is aligned closely adjacent to a rim of the paddle when the paddle is in the first state, and wherein, in the ejection state, at least a portion of the rim of the paddle is spaced apart from the protrusion, thereby forming a liquid refill channel defined between the wall structure and the portion of the rim of the paddle.

5 Claims, 28 Drawing Sheets

Mask (Muitiple CMOS masks to this stage)

CMOS complete

Mask 1 micron sacrificial Polyimide

Mask 0.2 micron TiN

Mask 1.5 micron sacrificial Polyimide

Mask 0.05 micron $Si_xN_yH_z$, 0.2 micron TiN

Mask 6 microns sacrificial Polyimide

No Mask 2 microns conformal PECVD $Si_xN_yH_z$

Mask 1 micron nozzle tip etch of $Si_xN_yH_z$

Mask 1 micron nozzle roof etch of $Si_xN_yH_z$

No Mask 3 micron sacrificial protective polyimide

Mask (includes chip edges)

Back-etch using Bosch process

No Mask

Strip sacrificial material

No Mask

Package, bond, prime, and test

LIQUID EJECTION DEVICE

FIELD OF THE INVENTION

The present invention relates to the field of micro mechanical or micro electromechanical liquid ejection devices. The present invention will be described herein with reference to Micro Electro Mechanical Inkjet technology. However, it will be appreciated that the invention does have broader applications to other micro mechanical or micro electro-mechanical devices, e.g. micro electromechanical pumps.

BACKGROUND OF THE INVENTION

Micro mechanical and micro electromechanical devices are becoming increasingly popular and normally involve the creation of devices on the micrometer (micron) scale utilizing semi-conductor fabrication techniques. For a recent review on micro-mechanical devices, reference is made to the article "The Broad Sweep of Integrated Micro Systems" by S. Tom Picraux and Paul J. McWhorter published December 1998 in IEEE Spectrum at pages 24 to 33.

One form of micro electromechanical devices in popular use are ink jet printing devices in which ink is ejected from an ink ejection nozzle chamber. Many forms of ink jet devices are known.

Many different techniques on ink jet printing and associated devices have been invented. For a survey of the field, reference is made to an article by J Moore, "Non-Impact Printing: Introduction and Historical Perspective", Output Hard Copy Devices, Editors R Dubeck and S Sherr, pages 207 to 220 (1988).

Recently, a new form of ink jet printing has been developed by the present applicant, which is referred to as Micro Electro Mechanical Inkjet (MEMJET) technology. In one form of the MEMJET technology, ink is ejected from an ink ejection nozzle chamber utilising an electro mechanical actuator connected to a paddle or plunger which moves towards the ejection nozzle of the chamber for ejection of drops of ink from the ejection nozzle chamber.

The present invention concerns improvements to liquid ejection devices for use in the MEMJET technology or other micro mechanical or micro electromechanical devices.

SUMMARY OF THE INVENTION

In accordance with a first aspect of the present invention, there is provided a liquid ejection device comprising a nozzle chamber, an ejection paddle located within the nozzle chamber for ejecting liquid from the nozzle chamber though an aperture in one wall of the nozzle chamber when the paddle is moved from a first state into an ejection state, a liquid supply port arranged in a manner such that it is substantially closed by the lo paddle when the paddle is in the first state, and wherein the nozzle chamber comprises an internal protrusion on a wall structure thereof which is aligned closely adjacent to a rim of the paddle when the paddle is in the first state, and wherein, in the ejection state, at least a portion of the rim of the paddle is spaced apart from the protrusion, thereby forming a liquid refill channel defined between the wall structure and the portion of the rim of the paddle.

The internal protrusion may have a staircase-like cross-sectional profile.

The paddle and the internal protrusion are preferably formed in one deposition step.

The internal protrusion may be formed using a lower aspect ratio deposition step when compared to a high aspect ratio deposition step for forming the wall structure of the nozzle chamber.

The paddle may be substantially planar.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF THE PREFERRED AND OTHER EMBODIMENTS

In the preferred embodiment, a compact form of liquid ejection device is provided which utilizes a thermal bend actuator to eject ink from a nozzle chamber.

Figure 1:
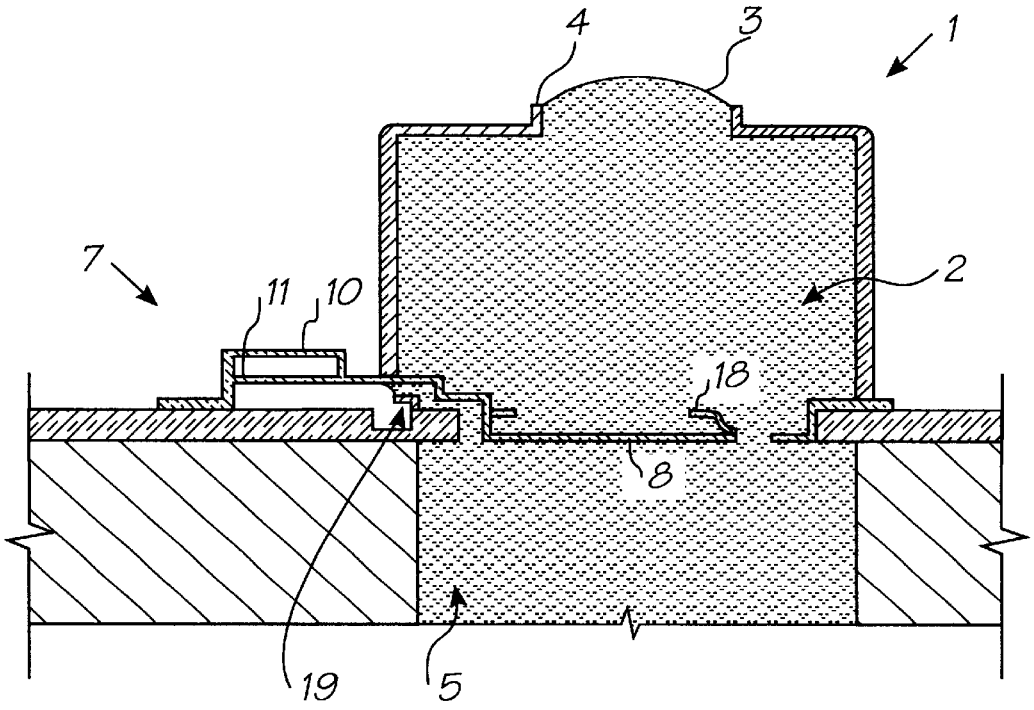
FIG. 1 to FIG. 3 illustrate schematically the operation of the preferred embodiment.
Figure 2:
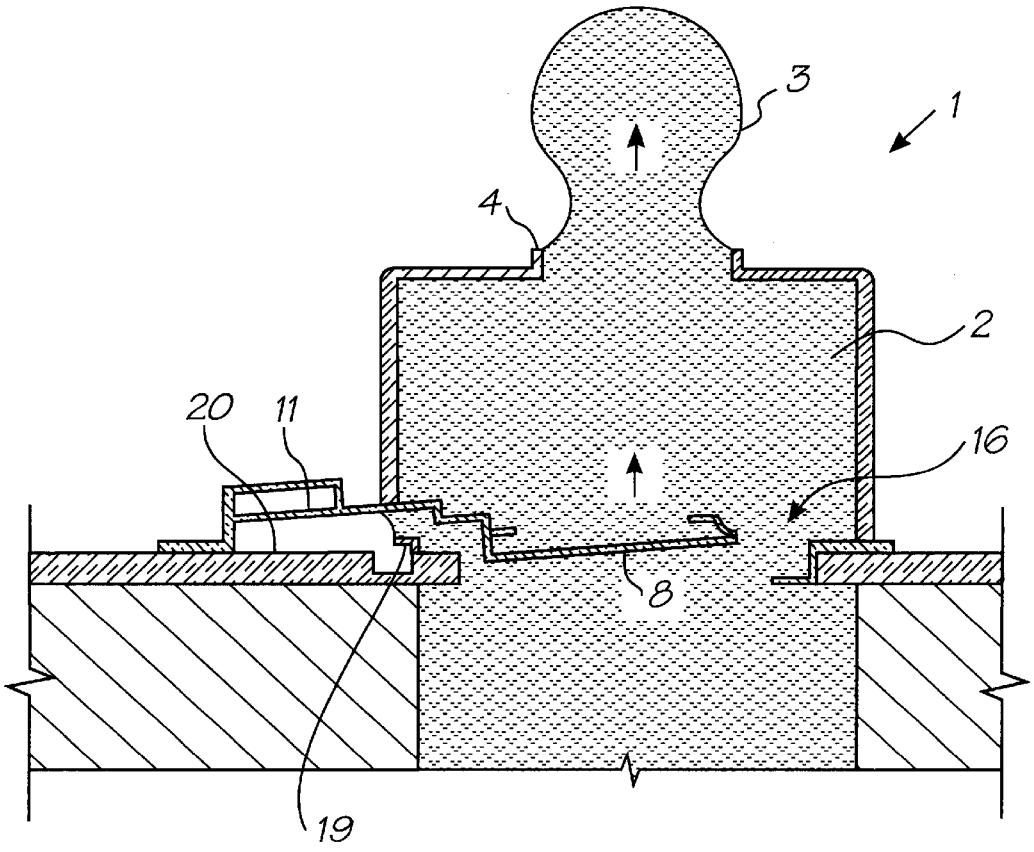
Figure 3:
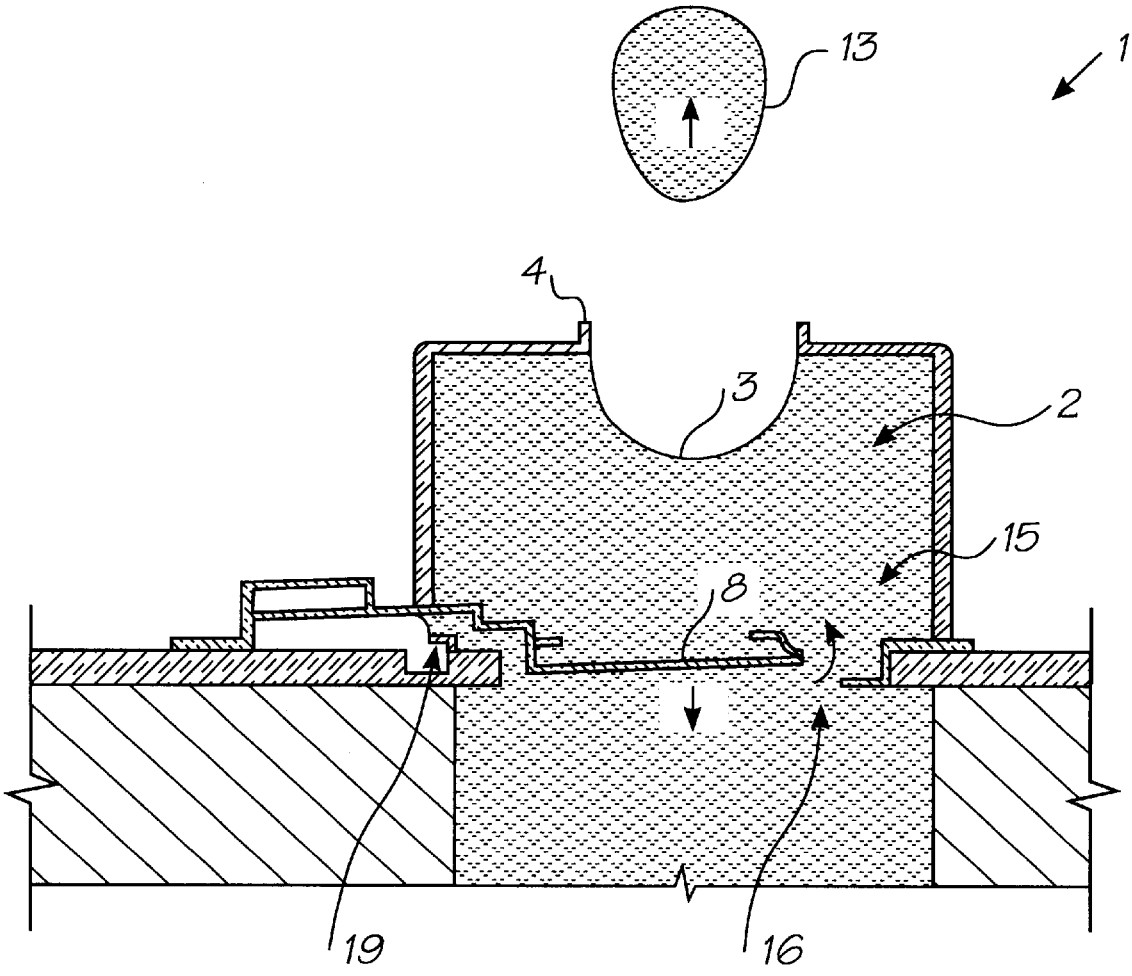

Turning initially to FIGS. 1–3 there will now be explained the operational principals of the preferred embodiment. As shown in FIG. 1, there is provided an ink ejection arrangement 1 which comprises a nozzle chamber 2 which is normally filled with ink so as to form a meniscus 3 around an ink ejection nozzle 4 having a raised rim. The ink within the nozzle chamber 2 is resupplied by means of ink supply channel 5.

The ink is ejected from a nozzle chamber 2 by means of a thermal actuator 7 which is rigidly interconnected to a nozzle paddle 8. The thermal actuator 7 comprises two arms 10, 11 with the bottom arm 11 being interconnected to a electrical current source so as to provide conductive heating of the bottom arm 11. When it is desired to eject a drop from the nozzle chamber 2, the bottom arm 11 is heated so as to cause the rapid expansion of this arm 11 relative to the top arm 10. The rapid expansion in turn causes a rapid upward movement of the paddle 8 within the nozzle chamber 2. The initial movement is illustrated in FIG. 2 with the arm 8 having moved upwards so as to cause a substantial increase in pressure within the nozzle chamber 2 which in turn causes ink to flow out of the nozzle 4 causing the meniscus 3 to bulge. Subsequently, the current to the heater 11 is turned off so as to cause the paddle 8 as shown in FIG. 3 to begin to return to its original position. This results in a substantial decrease in the pressure within the nozzle chamber 2. The forward momentum of the ink outside the nozzle rim 4 results in a necking and breaking of the meniscus so as to form meniscus 3 and a bubble 13 as illustrated in FIG. 3. The bubble 13 continues forward onto the ink print medium.

Importantly, the nozzle chamber comprises a profile edge 15 which, as the paddle 8 moves up, causes a large increase in the channel space 16 as illustrated in FIG. 2. This large channel space 16 allows for substantial amounts of ink to flow rapidly into the nozzle chamber 2 with the ink being drawn through the channel 16 by means of surface tension effects of the ink meniscus 3. The profiling of the nozzle chamber allows for the rapid refill of the nozzle chamber with the arrangement eventually returning to the quiescent position as previously illustrated in FIG. 1.

The arrangement 1 also comprises a number of other significant features. These comprise a circular rim 18, as shown in FIG. 1 which is formed around an external circumference of the paddle 8 and provides for structural support for the paddle 8 whilst substantially maximising the distance between the meniscus 3, as illustrated in FIG. 3 and the paddle surface 8. The maximising of this distance reduces the likelihood of meniscus 3 making contact with the paddle surface 8 and thereby affecting the operational characteristic. Further, as part of the manufacturing steps, an ink outflow prevention lip 19 is provided for reducing the possibility of ink wicking along a surface eg. 20 and thereby affecting the operational characteristics of the arrangement 1.

Figure 4:
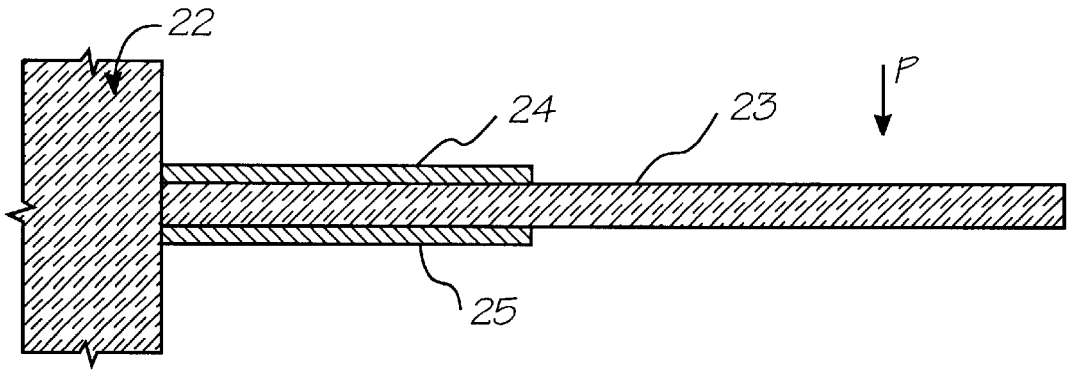
FIG. 4 to FIG. 6 illustrate schematically a first thermal bend actuator.
Figure 5:
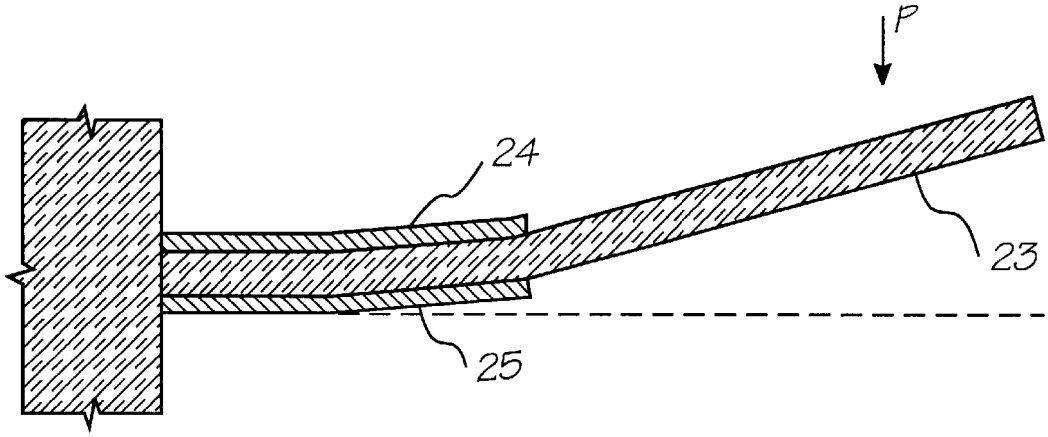

The principals of operation of the thermal actuator 7 will now be discussed initially with reference to FIG. 4 to 10. Turning initially to FIG. 4, there is shown, a thermal bend actuator attached to a substrate 22 which comprises an actuator arm 23 on both sides of which are activating arms 24, 25. The two arms 24, 25 are preferably formed from the same material so as to be in a thermal balance with one another. Further, a pressure P is assumed to act on the surface of the actuator arm 23. When it is desired to increase the pressure, as illustrated in FIG. 5, the bottom arm 25 is heated so as to reduce the tensile stress between the top and bottom arm 24, 25. This results in an output resultant force on the actuator arm 23 which results in its general upward movement.

Figure 6:
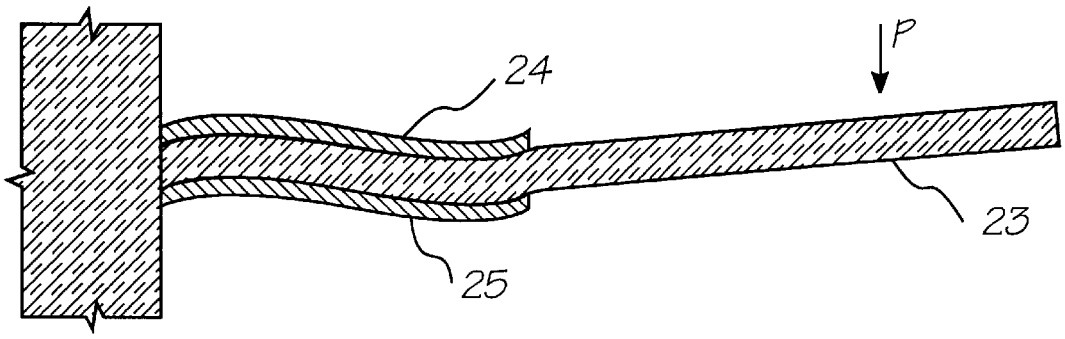
Figure 7:
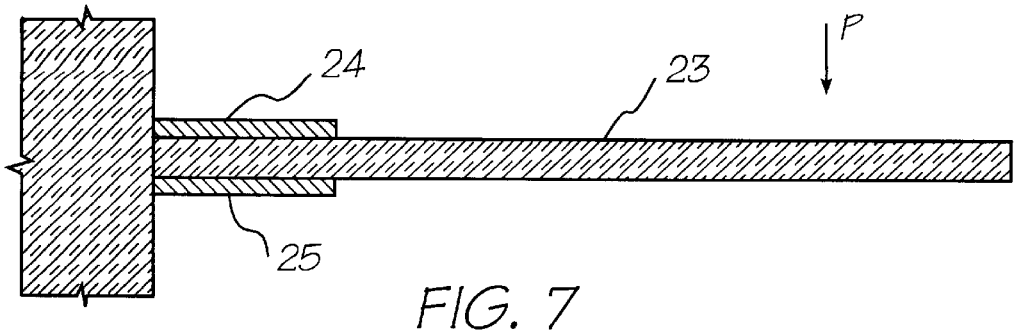
FIG. 7 to FIG. 8 illustrate schematically a second thermal bend actuator.

Unfortunately, it has been found in practice that, if the arms 24, 25 are too long, then the system is in danger of entering a buckling state as illustrated in FIG. 6 upon heating of the arm 25. This buckling state reduces the operational effectiveness of the actuator arm 23. The opportunity for the buckling state as illustrated in FIG. 6 can be substantially reduced through the utilisation of a smaller thermal bending arms 24, 25 with the modified arrangement being as illustrated in FIG. 7. It is found that, when heating the lower thermal arm 25 as illustrated in FIG. 8, the actuator arm 23 bends in a upward direction and the possibility for the system to enter the buckling state of FIG. 6 is substantially reduced.

Figure 8:
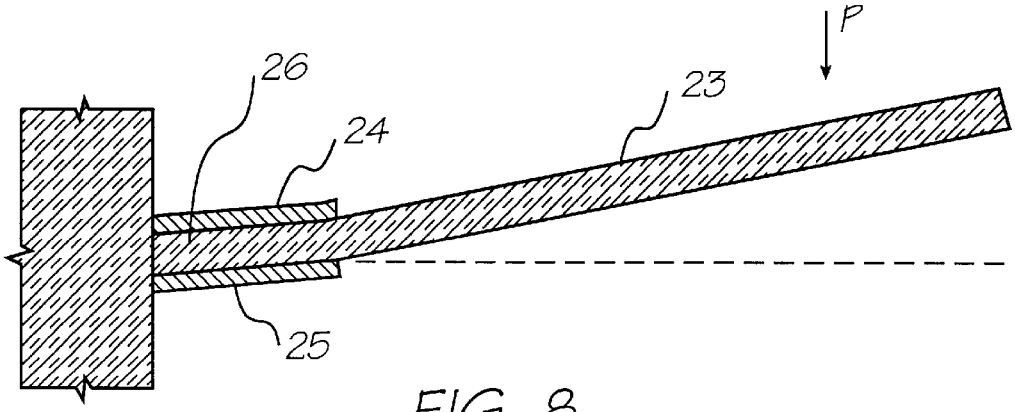

In the arrangement of FIG. 8, the portion 26 of the actuator arm 23 between the activating portion 24, 25 will be in a state of shear stress and, as a result, efficiencies of operation may be lost in this embodiment. Further, the presence of the material 26 can resulted in rapid thermal conductivity from the arm portion 25 to the arm portion 24.

Further, the thermal arm 25 must be operated at a temperature which is suitable for operating the arm 23. Hence, the operational characteristics are limited by the characteristics, eg. melting point, of the portion 26.

Figure 9:
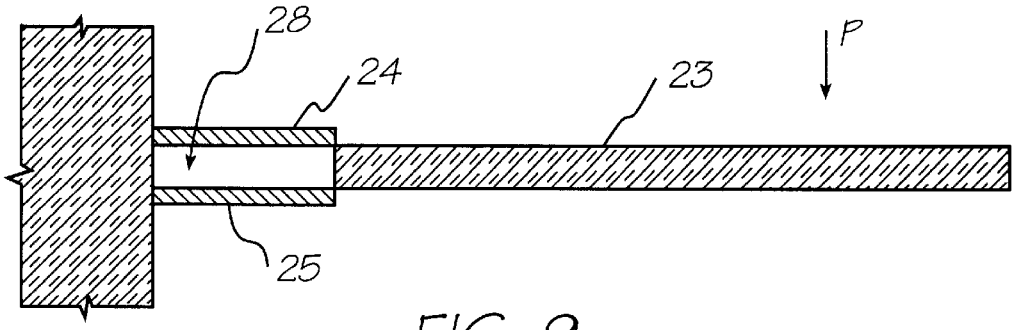
FIG. 9 to FIG. 10 illustrate schematically a third thermal bend actuator.
Figure 10:
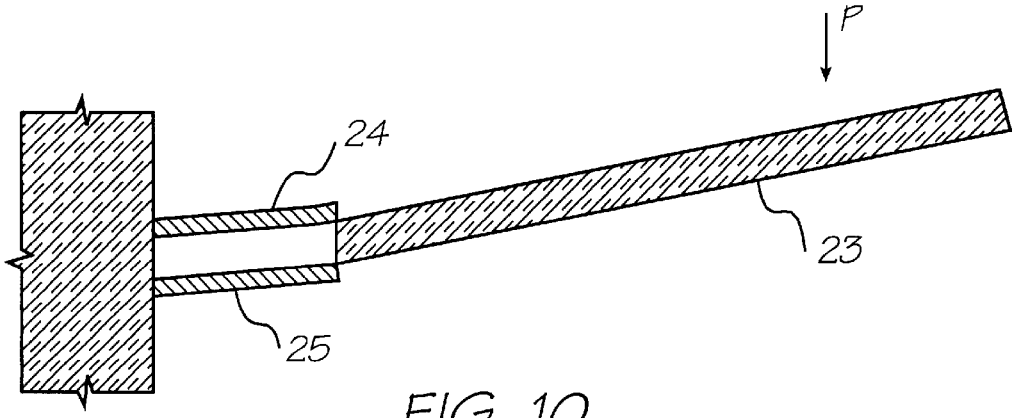

In FIG. 9, there is illustrated an alternative form of thermal bend actuator which comprises the two arms 24, 25 and actuator arm 23 but wherein there is provided a space or gap 28 between the arms. Upon heating one of the arms, as illustrated in FIG. 10, the arm 25 bends upward as before. The arrangement of FIG. 10 has the advantage that the operational characteristics eg. temperature, of the arms 24, 25 may not necessarily be limited by the material utilized in the arm 23. Further, the arrangement of FIG. 10 does not induce a sheer force in the arm 23 and also has a lower probability of delaminating during operation. These principals are utilized in the thermal bend actuator of the arrangement of FIG. 1 to FIG. 3 so as to provide for a more energy efficient form of operation.

Figure 11:
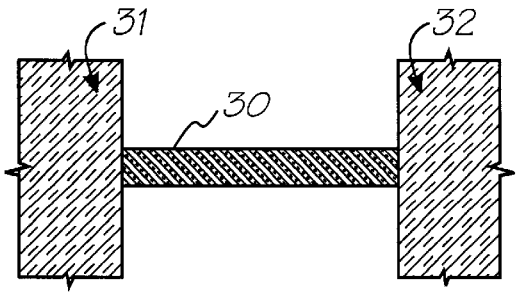
FIG. 11 illustrates schematically a further thermal bend actuator.
Figure 12:
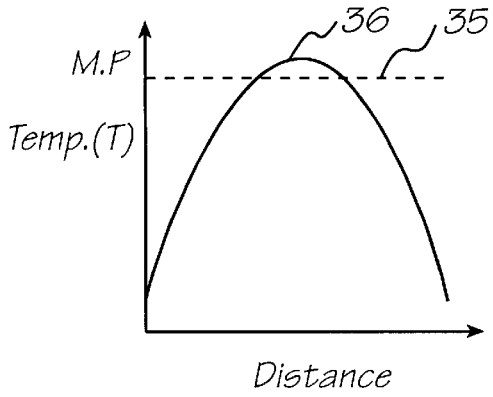
FIG. 12 illustrates an example graph of temperature with respect to distance for the arrangement of FIG. 11.

Further, in order to provide an even more efficient form of operation of the thermal actuator a number of further refinements are undertaken. A thermal actuator relies on conductive heating and, the arrangement utilized in the preferred embodiment can be schematically simplified as illustrated in FIG. 11 to a material 30 which is interconnected at a first end 31 to a substrate and at a second end 32 to a load. The arm 30 is conductively heated so as to expand and exert a force on the load 32. Upon conductive heating, the temperature profile will be approximately as illustrated in FIG. 12. The two ends 31, 32 act as "heat sinks" for the conductive thermal heating and so the temperature profile is cooler at each end and hottest in the middle. The operational characteristics of the arm 30 will be determined by the melting point 35 in that if the temperature in the middle 36 exceeds the melting point 35, the arm may fail. The graph of FIG. 12 represents a non optimal result in that the arm 30 in FIG. 11 is not heated uniformly along its length.

Figure 13:
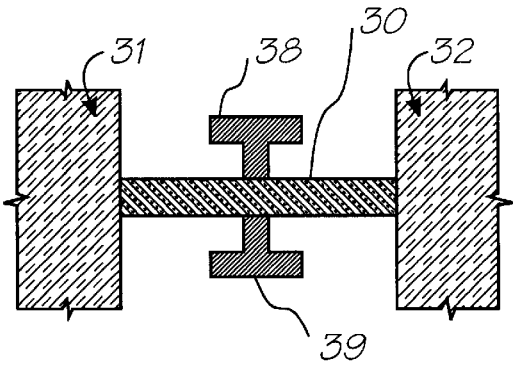
FIG. 13 illustrates schematically a further thermal bend actuator.
Figure 14:
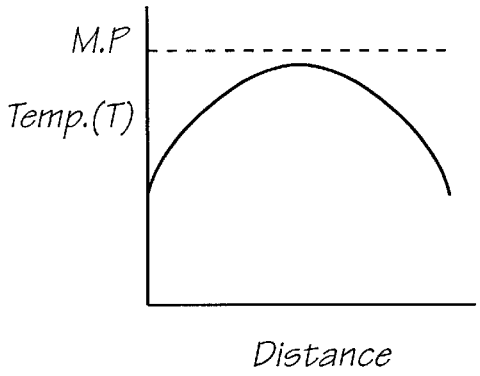
FIG. 14 illustrates an example graph of temperature with respect to distance for the arrangement of FIG. 13.

By modifying the arm 30, as illustrated in FIG. 13, through the inclusion of heat sinks 38, 39 in a central portion of the arm 30 a more optimal thermal profile, as illustrated in FIG. 14, can be achieved. The profile of FIG. 14 has a more uniform heating across the lengths of the arm 30 thereby providing for more efficient overall operation.

Figure 15:
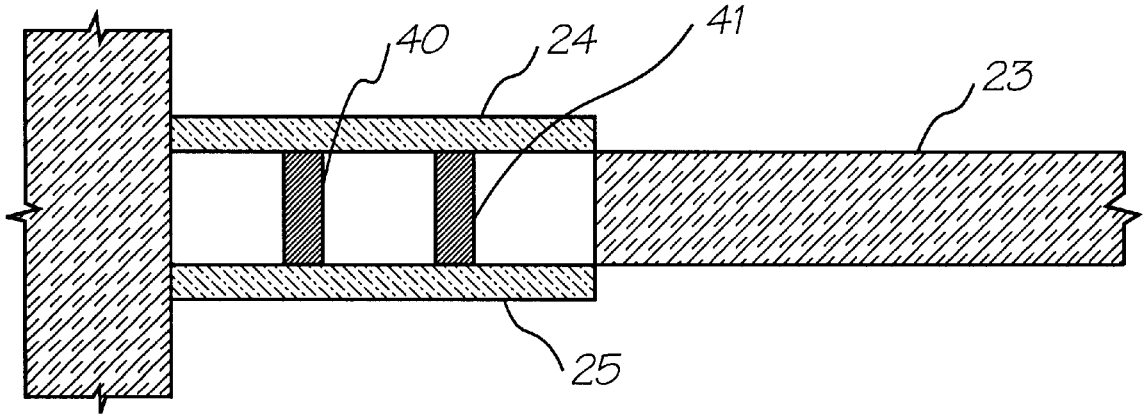
FIG. 15 illustrates schematically a further thermal bend actuator.

Turning to FIG. 15, further efficiencies and reduction in buckling likelihood can be achieved by providing a series of struts to couple the two actuator activation arms 24, 25. Such an arrangement is illustrated schematically in FIG. 15 where a series of struts, eg. 40, 41 are provided to couple the two arms 24, 25 so as to prevent buckling thereof. Hence, when the bottom arm 25 is heated, it is more likely to bend upwards causing the actuator arm 23 also to bend upwards.

Figure 17:
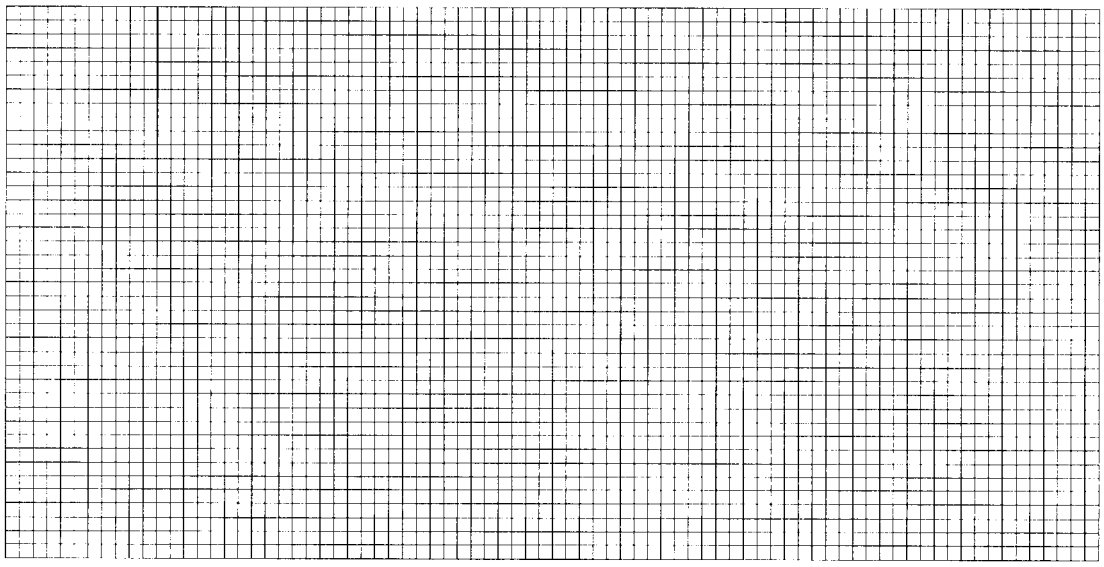
FIG. 17 illustrates a 1 micron mask.

One form of detailed construction of a ink jet printing MEMS device will now be described. In some of the Figures, a 1 micron grid, as illustrated in FIG. 17 is utilized as a frame of reference.

Figure 16:
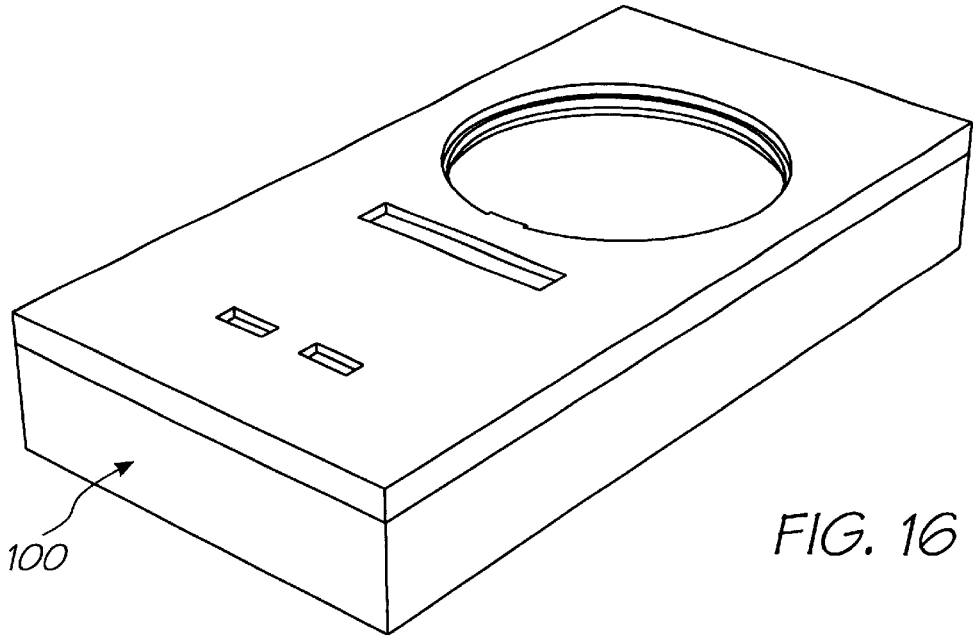
FIG. 16 illustrates a side perspective view of the CMOS layer of the preferred embodiment.
Figure 18:
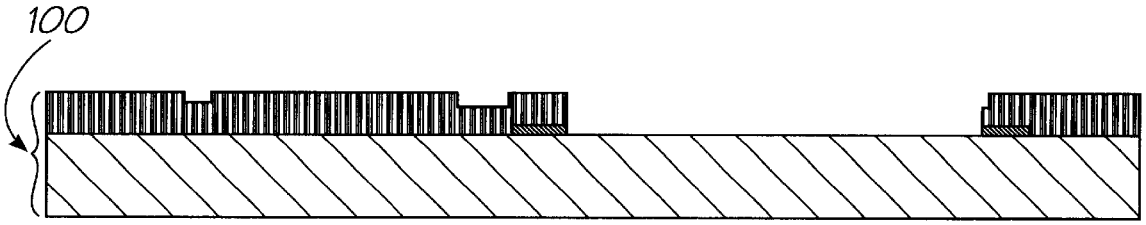
FIG. 18 illustrates a plan view of a portion of the CMOS layer.
Figure 19:
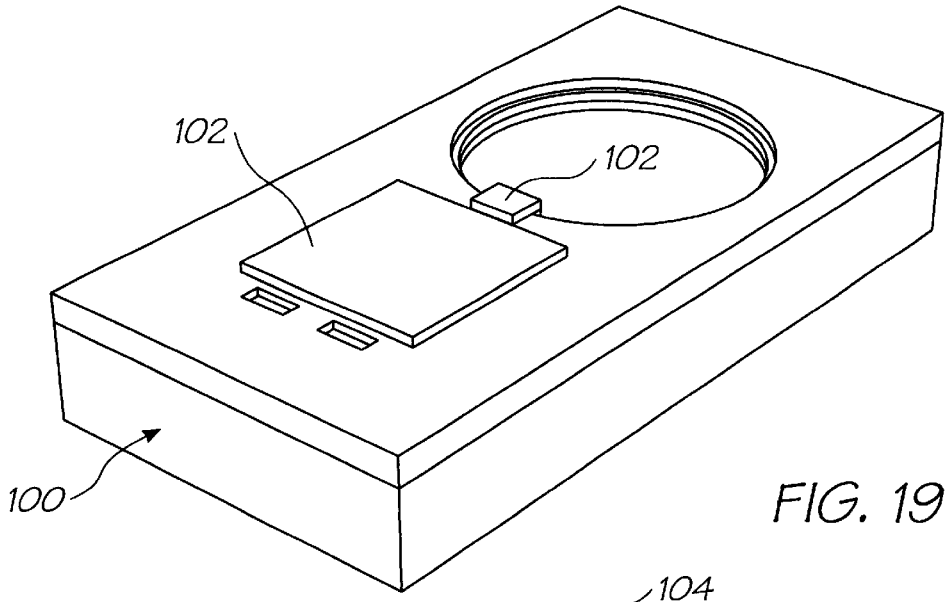
FIG. 19 illustrates a side perspective view of the preferred embodiment with the sacrificial Polymide Layer.
Figure 20:
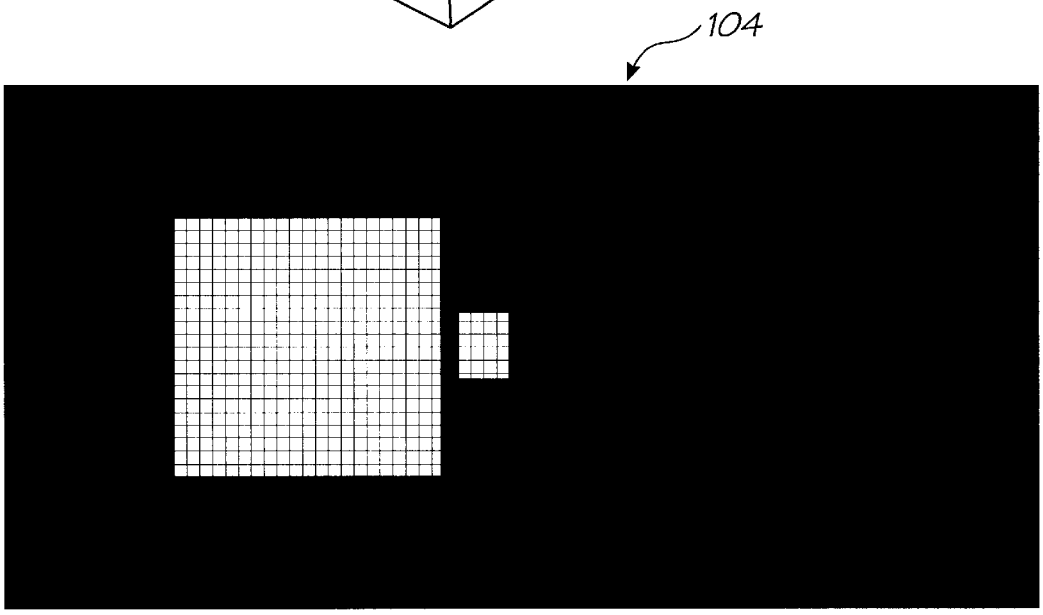
FIG. 20 illustrates a plan view of the sacrificial Polyimide mask.
Figure 21:
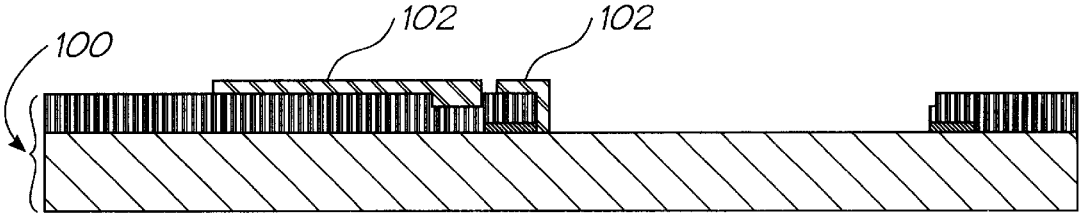
FIG. 21 illustrates a side plan view, partly in section, of the preferred embodiment with the sacrificial Polyimide Layer.
Figure 22:
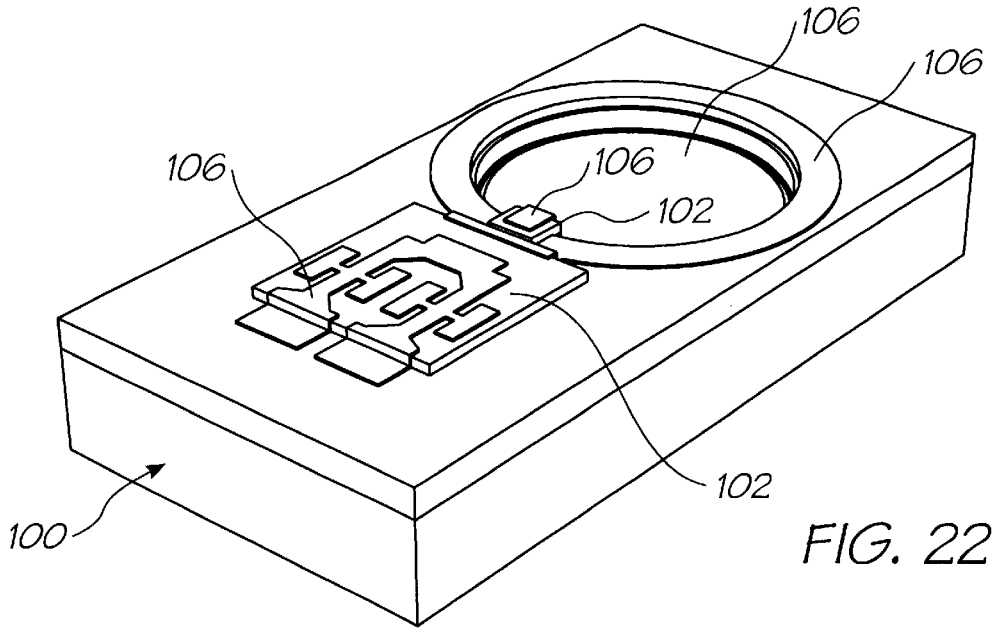
FIG. 22 illustrates a side perspective view of the preferred embodiment with the first level Titanium Nitride Layer.
Figure 23:
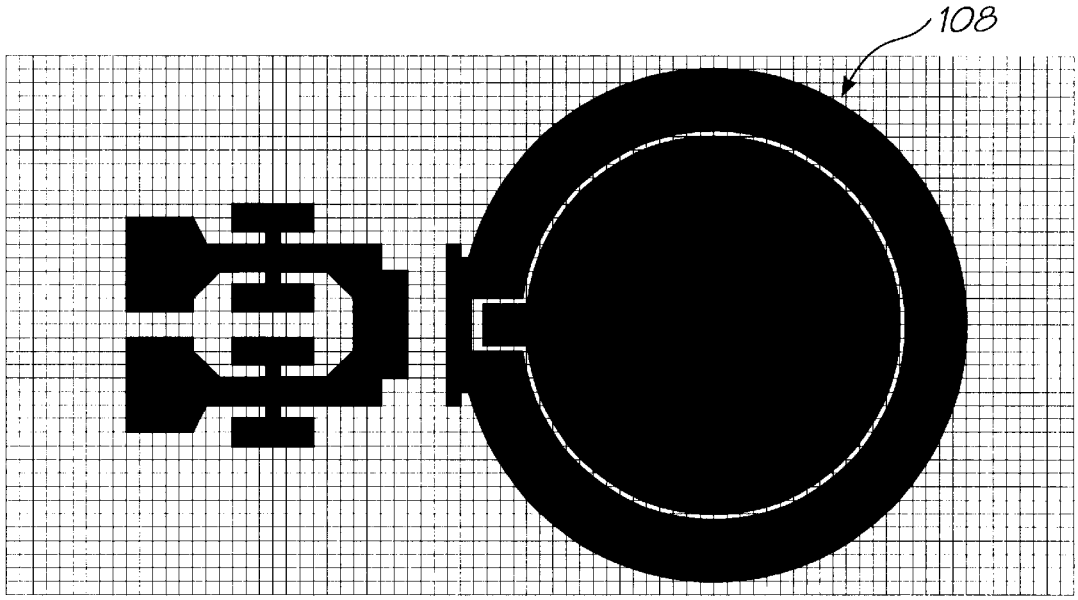
FIG. 23 illustrates a plan view of the first level Titanium Nitride mask.
Figure 24:
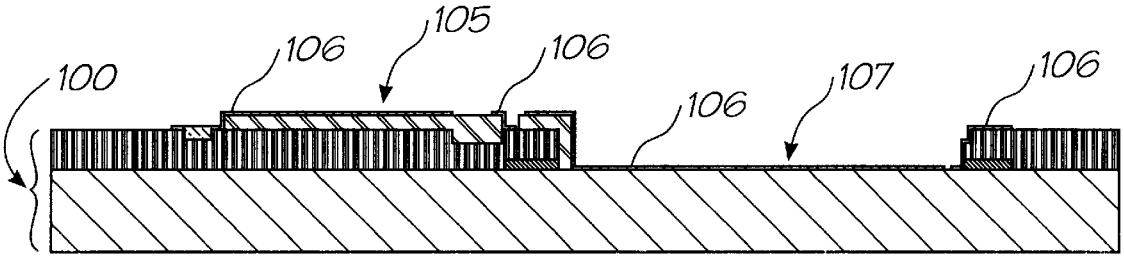
FIG. 24 illustrates a side plan view, partly in section, of the preferred embodiment with the first level Titanium Nitride Layer.
Figure 25:
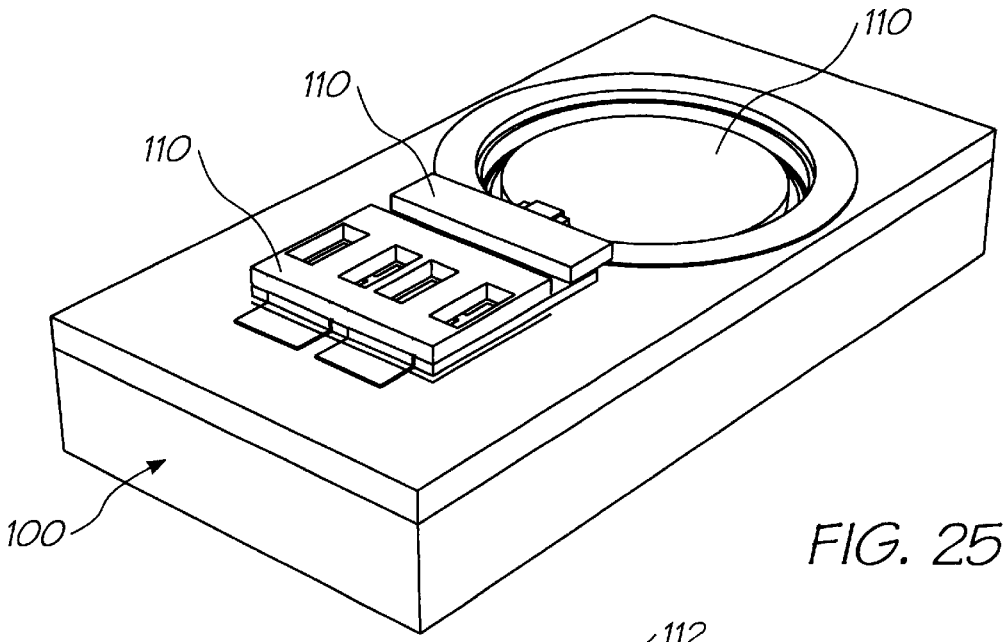
FIG. 25 illustrates a side perspective view of the preferred embodiment with the second level sacrificial Polyimide Layer.
Figure 26:
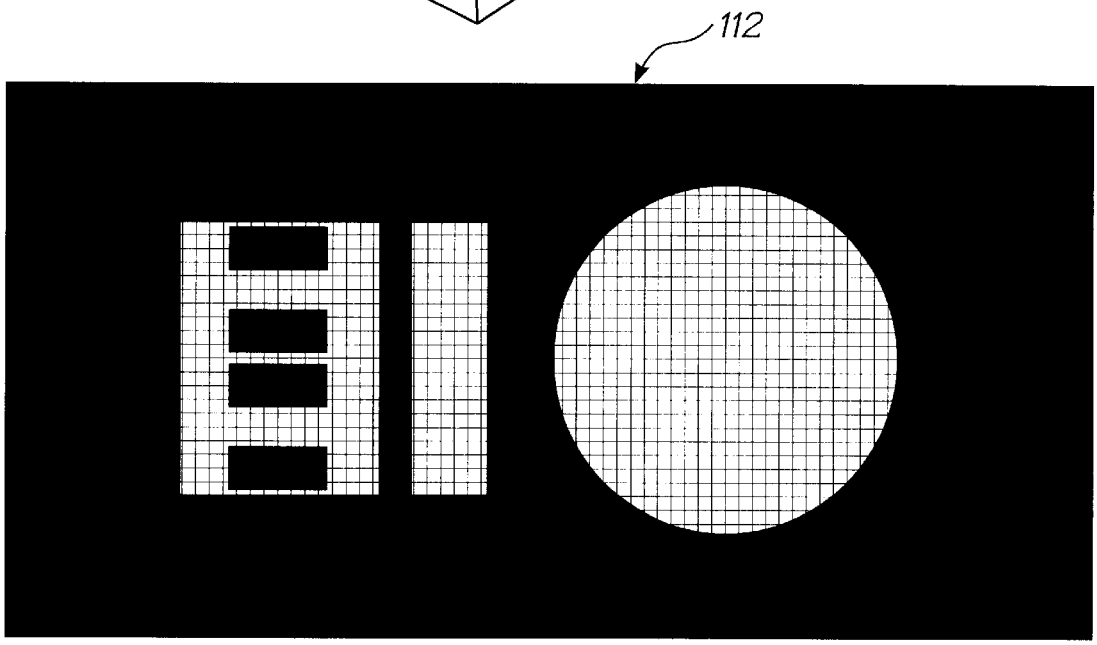
FIG. 26 illustrates a plan view of the second level sacrificial Polyimide mask.
Figure 27:
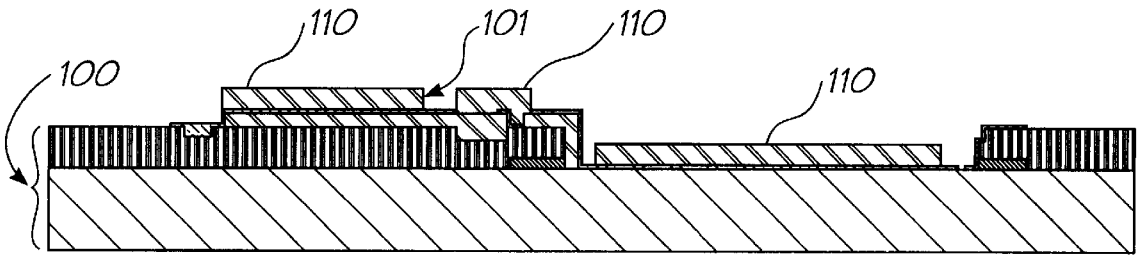
FIG. 27 illustrates a side plan view, partly in section, of the preferred embodiment with the second level sacrificial Polyimide Layer.

1 & 2. The starting material is assumed to be a CMOS wafer 100, suitably processed and passivated (using say silicon nitride) as illustrated in FIG. 16 to FIG. 18.

3. As shown in FIG. 19 to FIG. 21, 1 micron of spin-on photosensitive polyimide 102 is deposited and exposed using UV light through the Mask 104 of FIG. 20. The polyimide 102 is then developed.

The polyimide 102 is sacrificial, so there is a wide range of alternative materials which can be used. Photosensitive polyimide simplifies the processing, as it eliminates deposition, etching, and resist stripping steps.

4. As shown in FIG. 22 to FIG. 24, 0.2 microns of magnetron sputtered titanium nitride 106 is deposited at 300°C and etched using the Mask 108 of FIG. 23. This forms a layer containing the actuator layer 105 and paddle 107.

5. As shown in FIG. 25 to FIG. 27, 1.5 microns of photosensitive polyimide 110 is spun on and exposed using UV light through the Mask 112 of FIG. 26. The polyimide 110 is then developed. The thickness ultimately determines the gap 101 between the actuator and compensator Tin layers, so has an effect on the amount that the actuator bends.

As with step 3, the use of photosensitive polyimide simplifies the processing, as it eliminates deposition, etching, and resist stripping steps.

Figure 28:
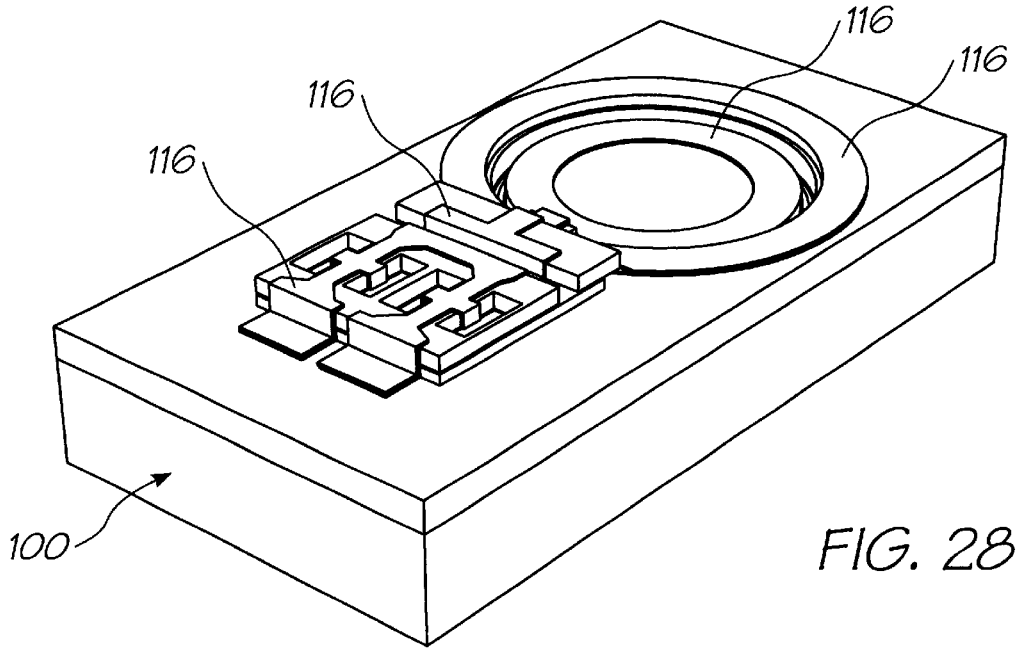
FIG. 28 illustrates a side perspective view of the preferred embodiment with the second level Titanium Nitride Layer.
Figure 29:
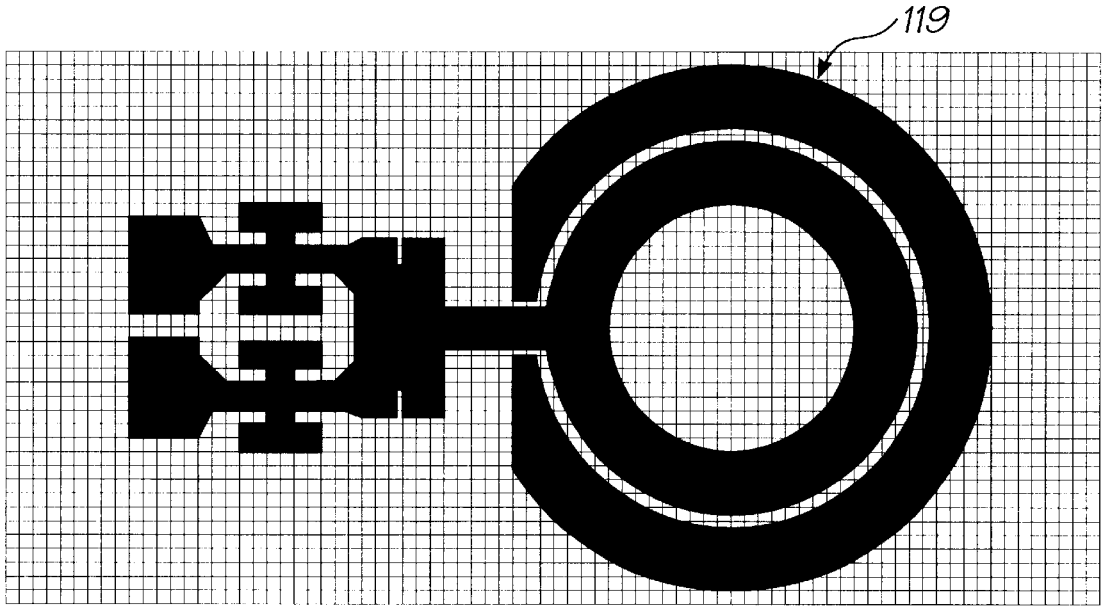
FIG. 29 illustrates a plan view of the second level Titanium Nitride mask.
Figure 30:
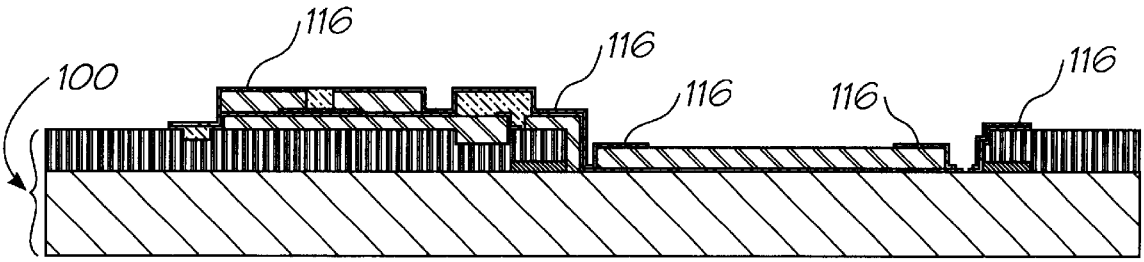
FIG. 30 illustrates a side plan view, partly in section, of the preferred embodiment with the second level Titanium Nitride Layer.
Figure 31:
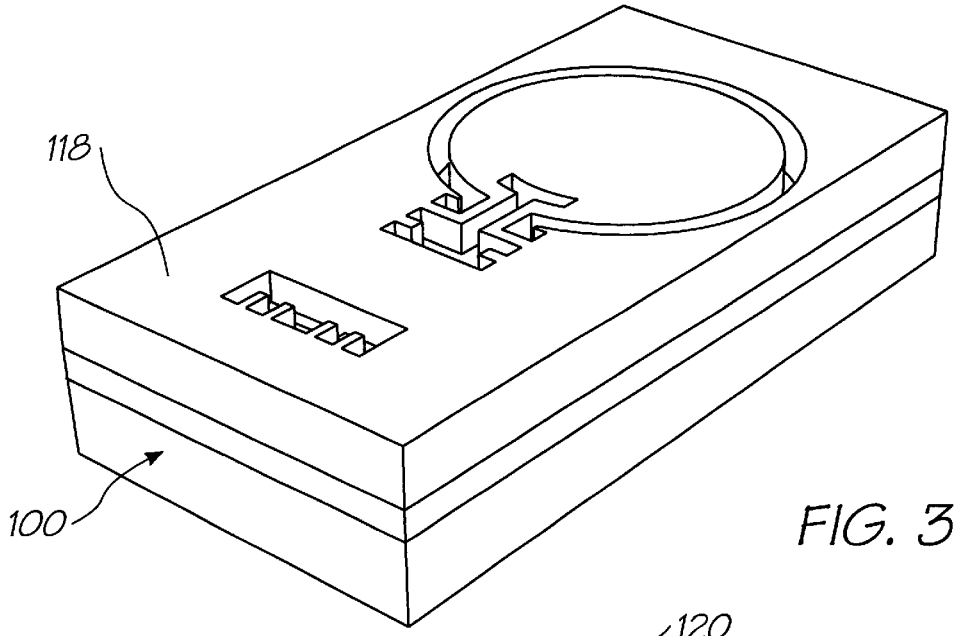
FIG. 31 illustrates a side perspective view of the preferred embodiment with the third level sacrificial Polyimide Layer.
Figure 32:
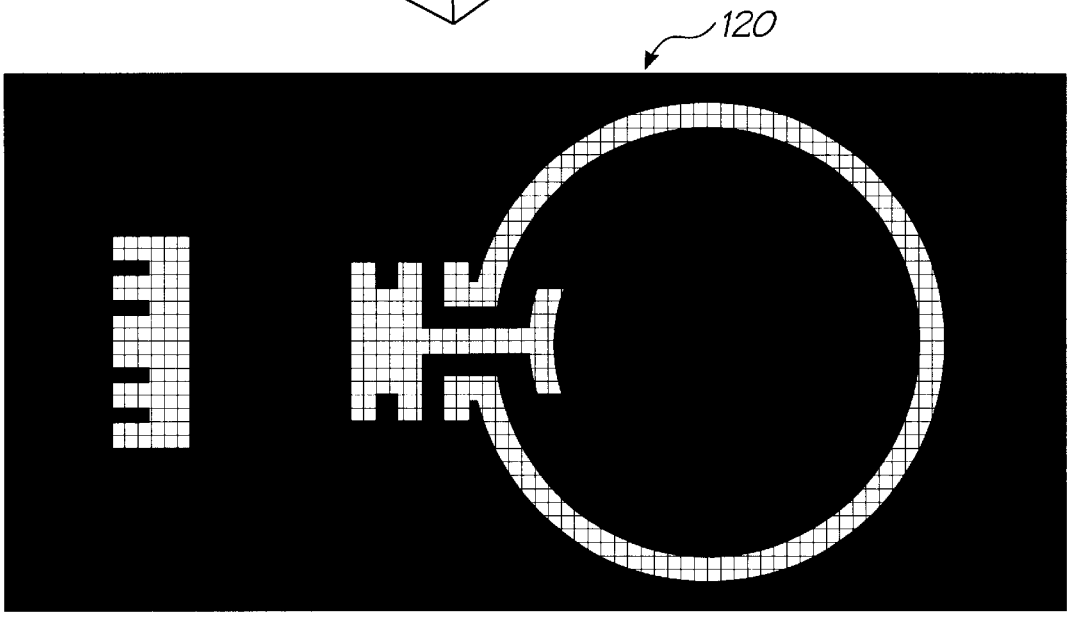
FIG. 32 illustrates a plan view of the third level sacrificial Polyimide mask.
Figure 33:
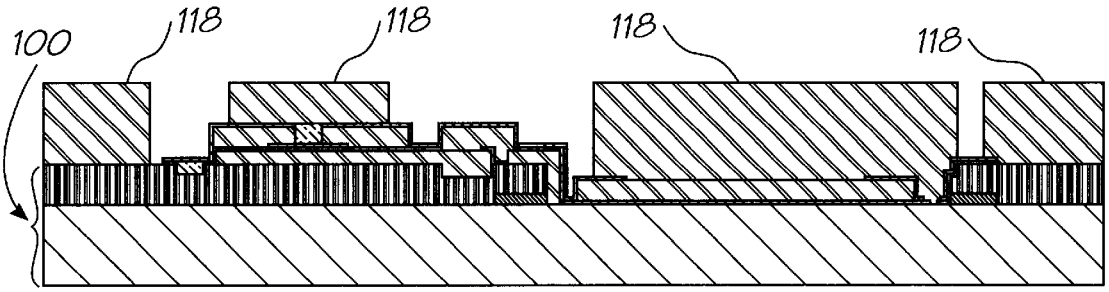
FIG. 33 illustrates a side plan view, partly in section, of the preferred embodiment with the third level sacrificial Polyimide Layer.
Figure 34:
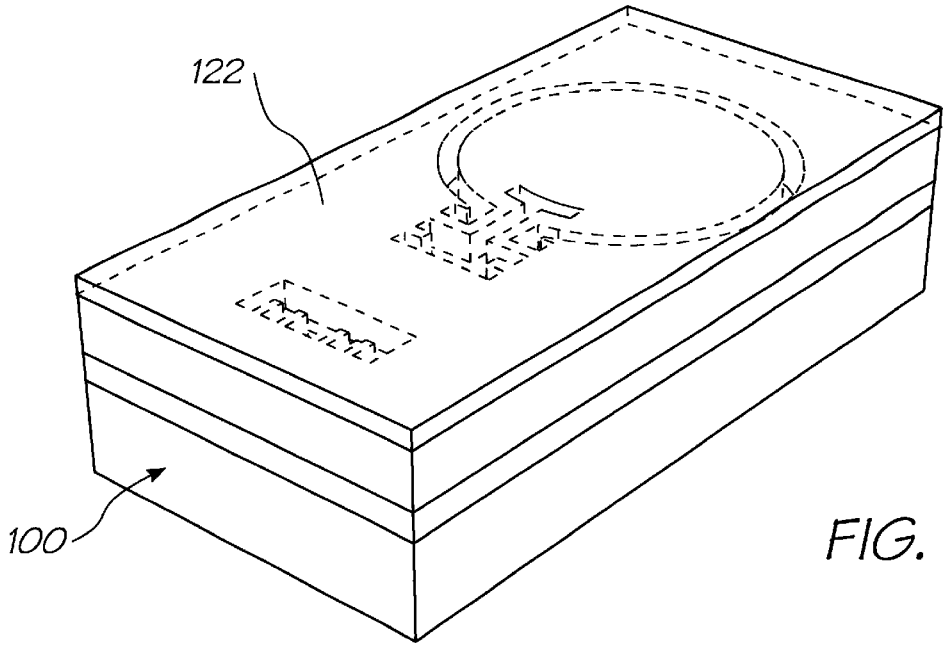
FIG. 34 illustrates a side perspective view of the preferred embodiment with the conferral PECVD SiNH Layer.

6. As shown in FIG. 28 to FIG. 30, deposit 0.05 microns of conformal PECVD silicon nitride ($Si_xN_yH_z$) (not shown because of relative dimensions of the various layers) at 300°C. Then 0.2 microns of magnetron sputtered titanium nitride 116 is deposited, also at 300°C. This TiN 116 is etched using the Mask 119 of FIG. 29. This TiN 116 is then used as a mask to etch the PECVD nitride.

Good step coverage of the TiN 116 is not important. The top layer of TiN 116 is not electrically connected, and is used purely as a mechanical component.

7. As shown in FIG. 31 to FIG. 33, 6 microns of photosensitive polyimide 118 is spun on and exposed using UV light through the Mask 120 of FIG. 32. The polyimide 118 is then developed. This thickness determines the height to the nozzle chamber roof. As long as this height is above a certain distance (determined by drop break-off characteristics), then the actual height is of little significance. However, the height should be limited to reduce stress and increase lithographic accuracy. A taper of 1 micron can readily be accommodated between the top and the bottom of the 6 microns of polyimide 118.

Figure 35:
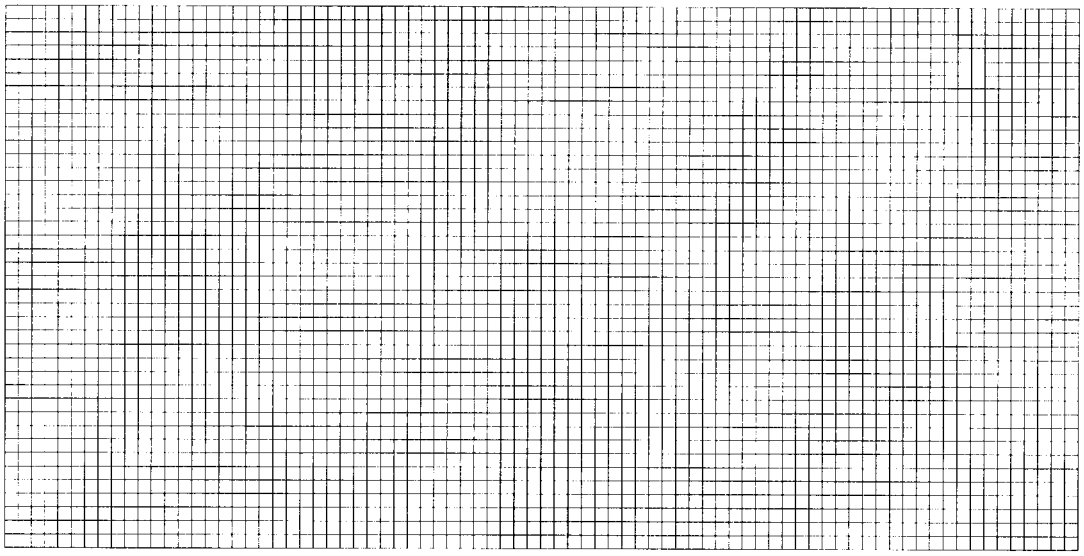
FIG. 35 illustrates a plan view of the conformal PECVD SiNH mask.
Figure 36:
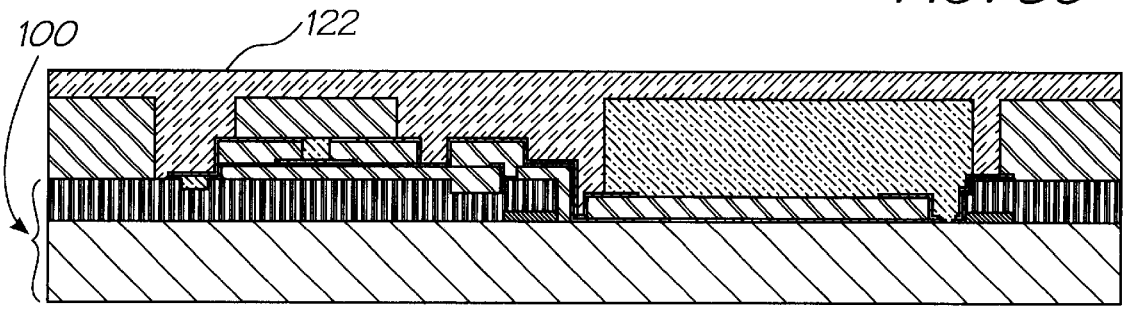
FIG. 36 illustrates a side plan view, partly in section, of the preferred embodiment with the conformal PECVD SiNH Layer.

8. As shown in FIG. 34 to FIG. 36, 2 microns (thickness above polyimide 118) of PECVD silicon nitride 122 is deposited at 300°C. This fills the channels formed in the previous PS polyimide layer 118, forming the nozzle chamber. No mask is used (FIG. 35).

Figure 37:
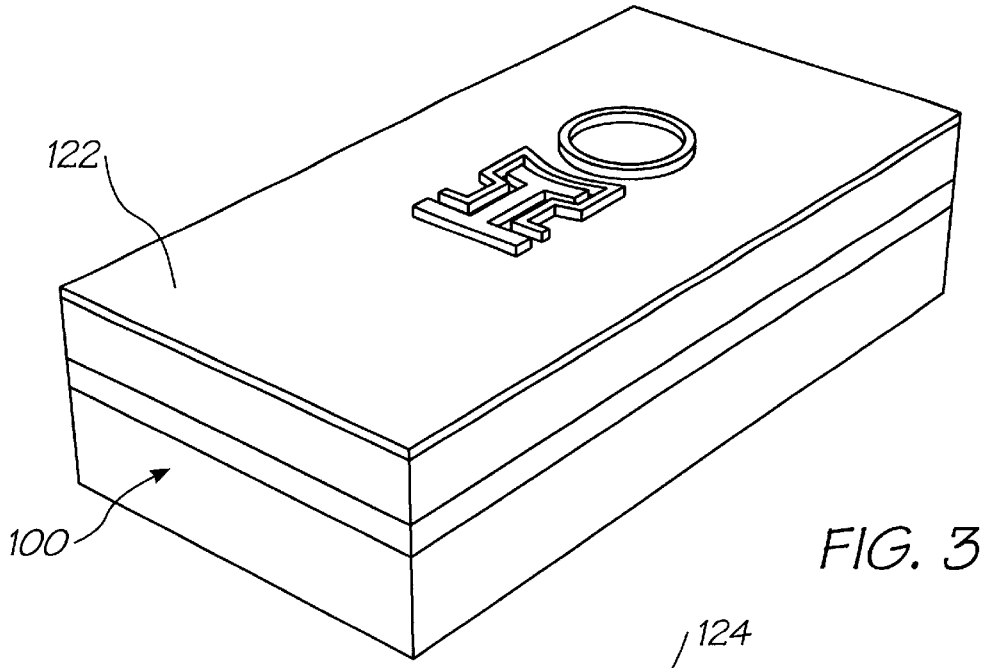
FIG. 37 illustrates a side perspective view of the preferred embodiment with the conformal PECVD SiNH nozzle tip etch Layer.
Figure 38:
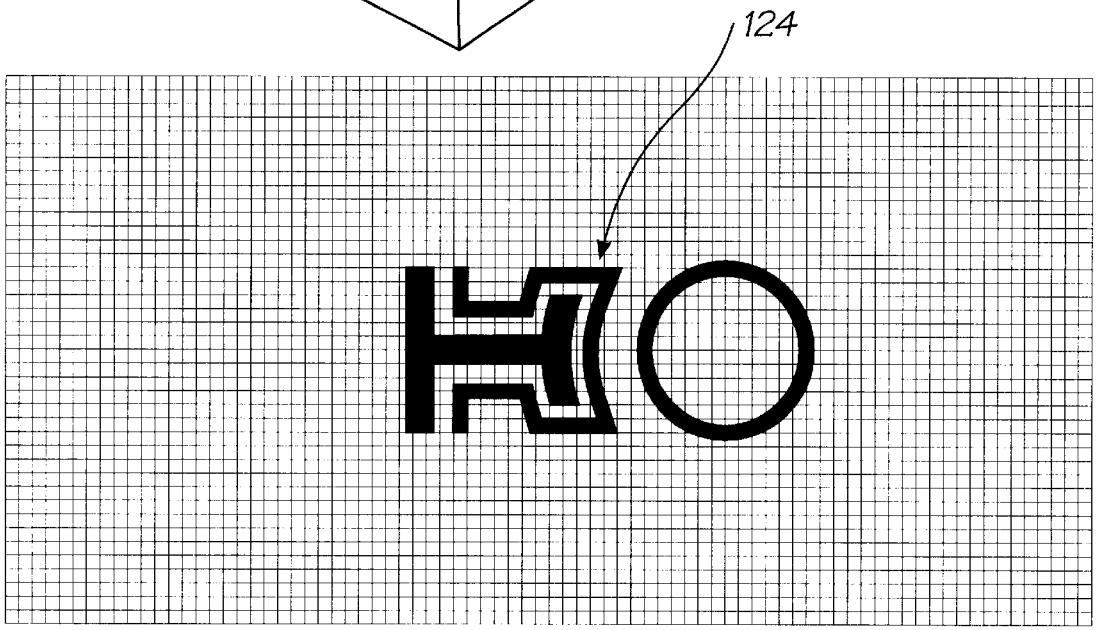
FIG. 38 illustrates a plan view of the conferral PECVD SiNH nozzle tip etch mask.
Figure 39:
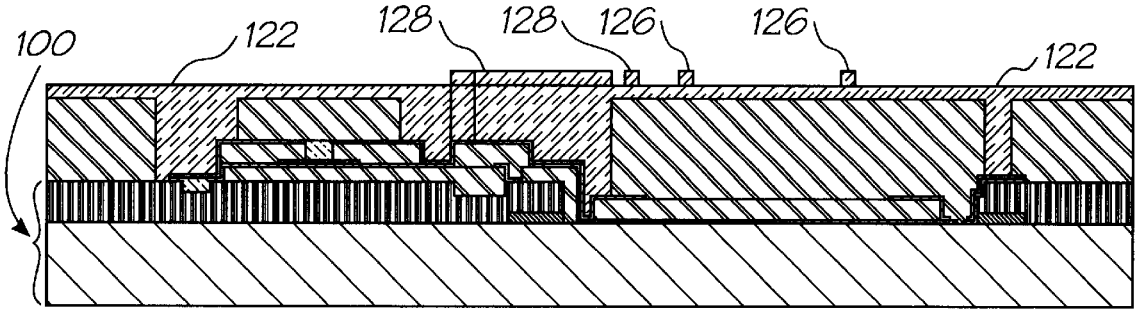
FIG. 39 illustrates a side plan view, partly in section, of the preferred embodiment with the conformal PECVD SiNH nozzle tip etch Layer.

9. As shown in FIG. 37 to FIG. 39, the PECVD silicon nitride 122 is etched using the mask 124 of FIG. 38 to a nominal depth of 1 micron. This is a simple timed etch as the etch depth is not critical, and may vary up to ↑ 50%.

The etch forms the nozzle rim 126 and actuator port rim 128. These rims are used to pin the meniscus of the ink to certain locations, and prevent the ink from spreading.

Figure 40:
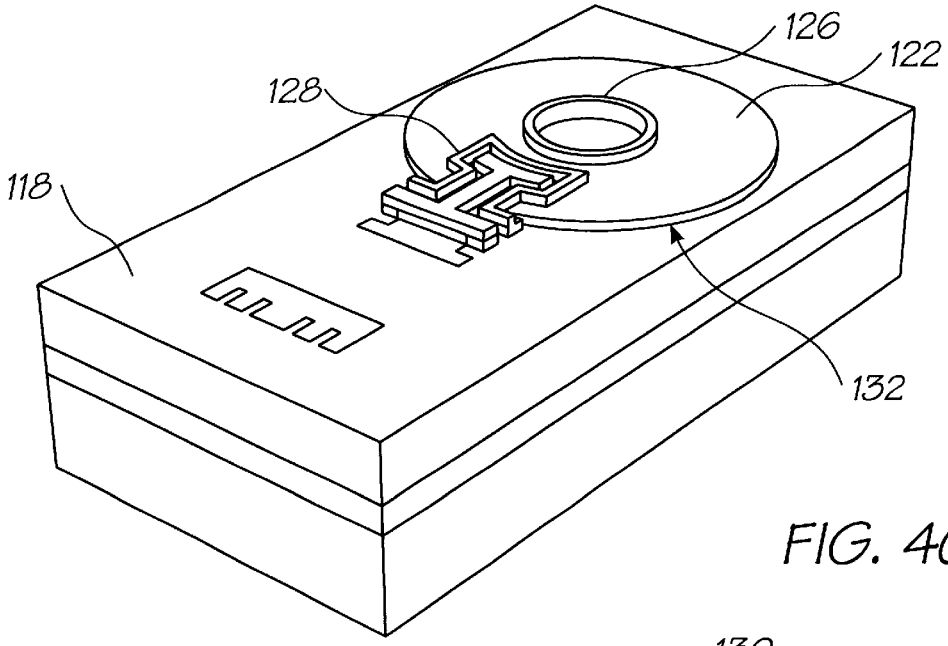
FIG. 40 illustrates a side perspective view of the preferred embodiment with the conformal PECVD SiNH nozzle roof etch Layer.
Figure 41:
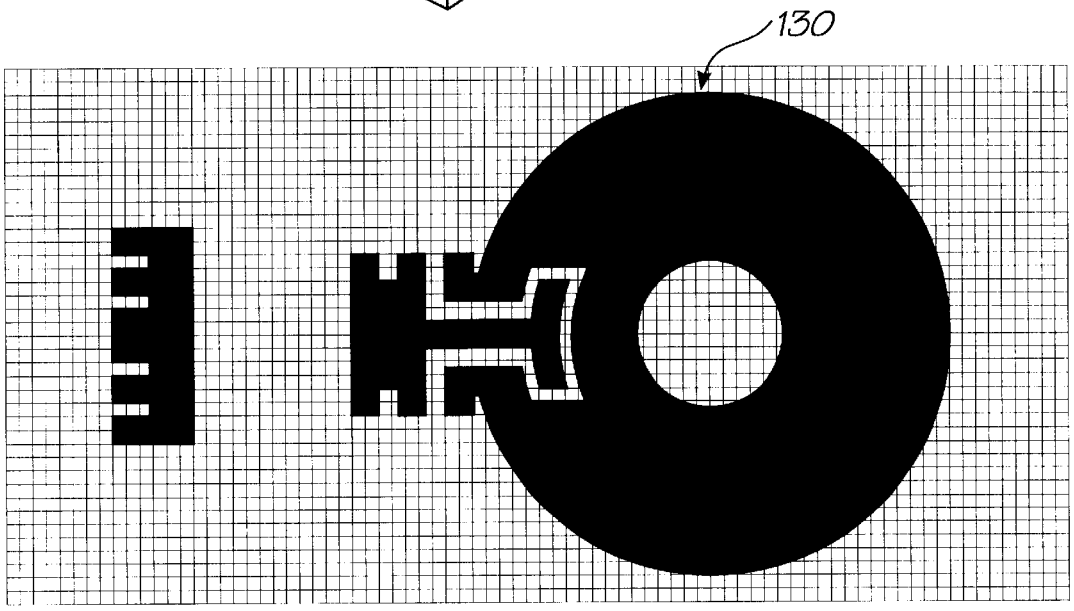
FIG. 41 illustrates a plan view of the conformal PECVD SiNH nozzle roof etch mask.
Figure 42:
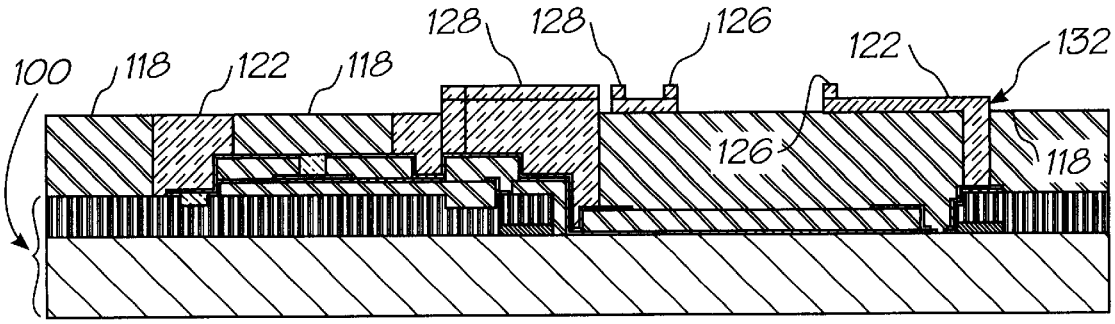
FIG. 42 illustrates a side plan view, partly in section, of the preferred embodiment with the conformal PECVD SiNH nozzle roof etch Layer.

10. As shown in FIG. 40 to FIG. 42, the PECVD silicon nitride 122 is etched using the mask 130 of FIG. 41 to a nominal depth of 1 micron, stopping on polyimide 118. A 100% over-etch can accommodate variations in the previous two steps, allowing loose manufacturing tolerances.

The etch forms the roof 132 of the nozzle chamber.

Figure 43:
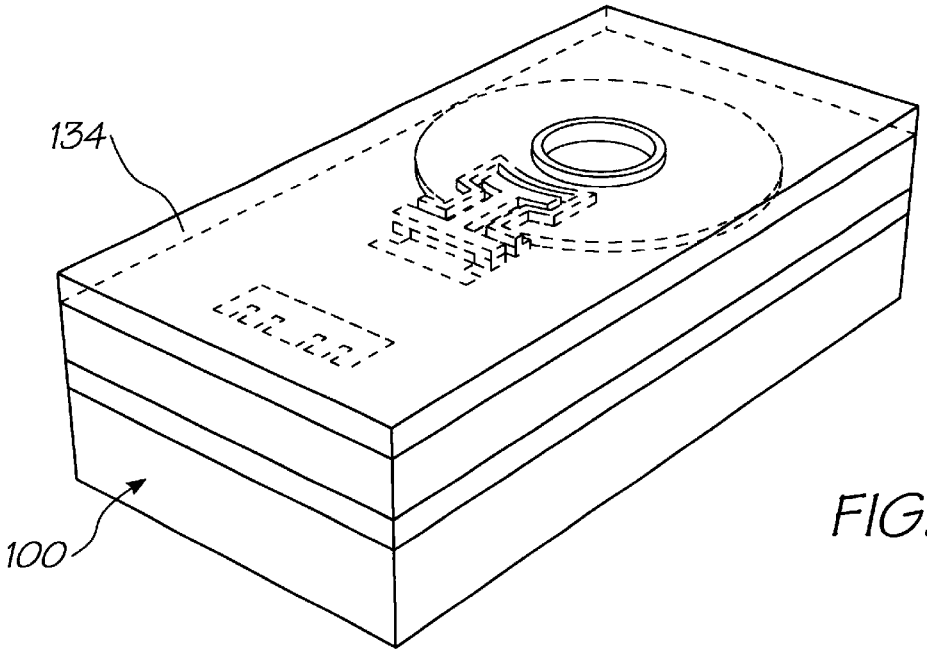
FIG. 43 illustrates a side perspective view of the preferred embodiment with the sacrificial protective polyimide Layer.
Figure 44:
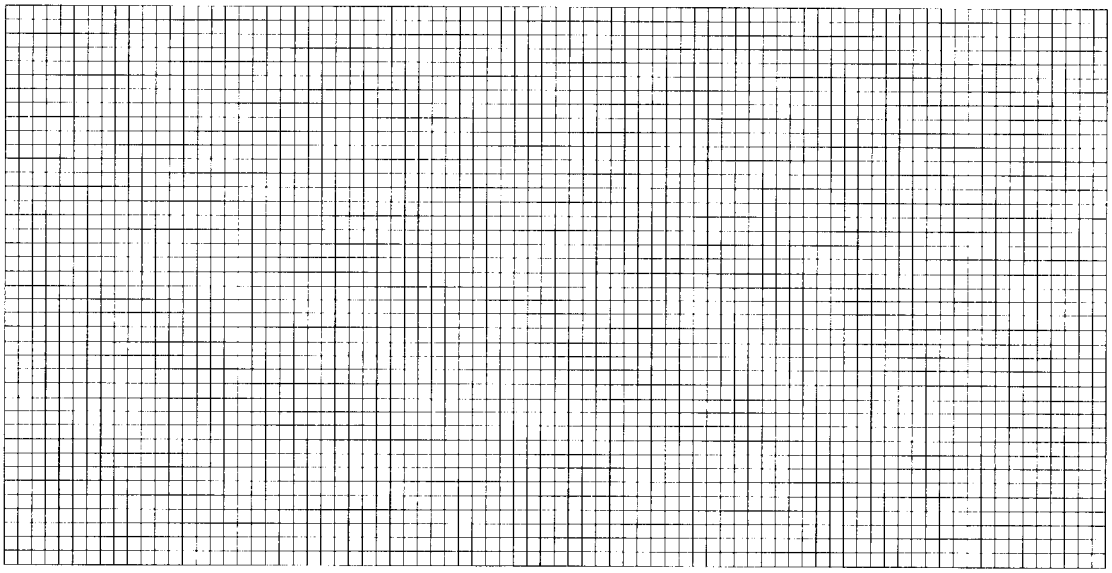
FIG. 44 illustrates a plan view of the sacrificial protective polyimide mask.
Figure 45:
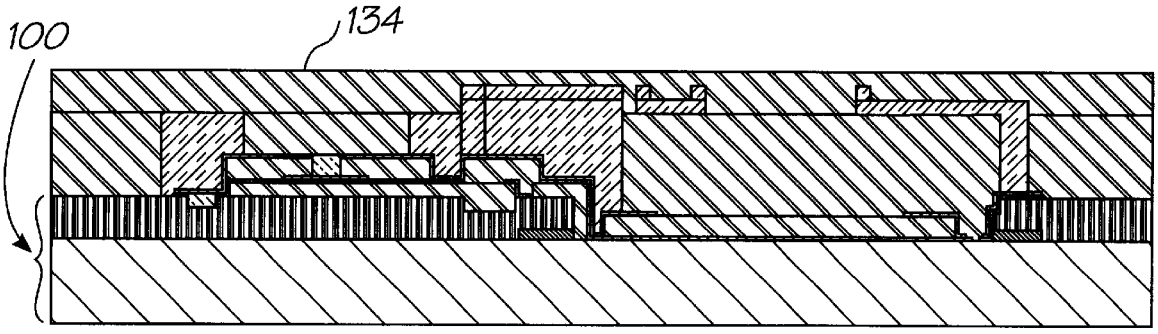
FIG. 45 illustrates a side plan view, partly in section, of the preferred embodiment with the sacrificial protective polyimide Layer.

11. As shown in FIG. 43 to FIG. 45, nominally 3 microns of polyimide 134 is spun on as a protective layer for back-etching (No Mask—FIG. 44).

Figure 46:
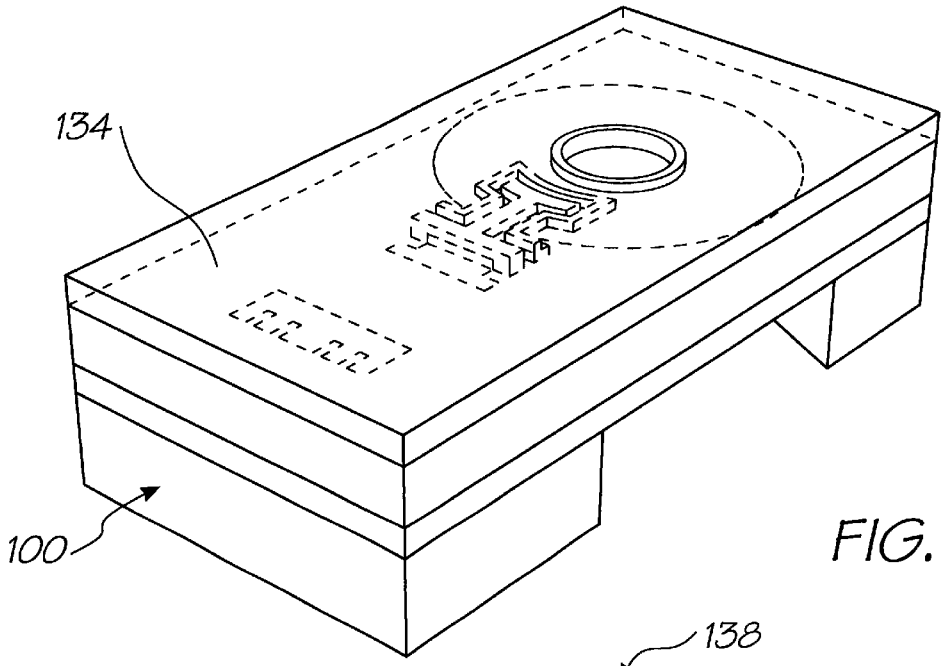
FIG. 46 illustrates a side perspective view of the preferred embodiment with the back etch Layer.
Figure 47:
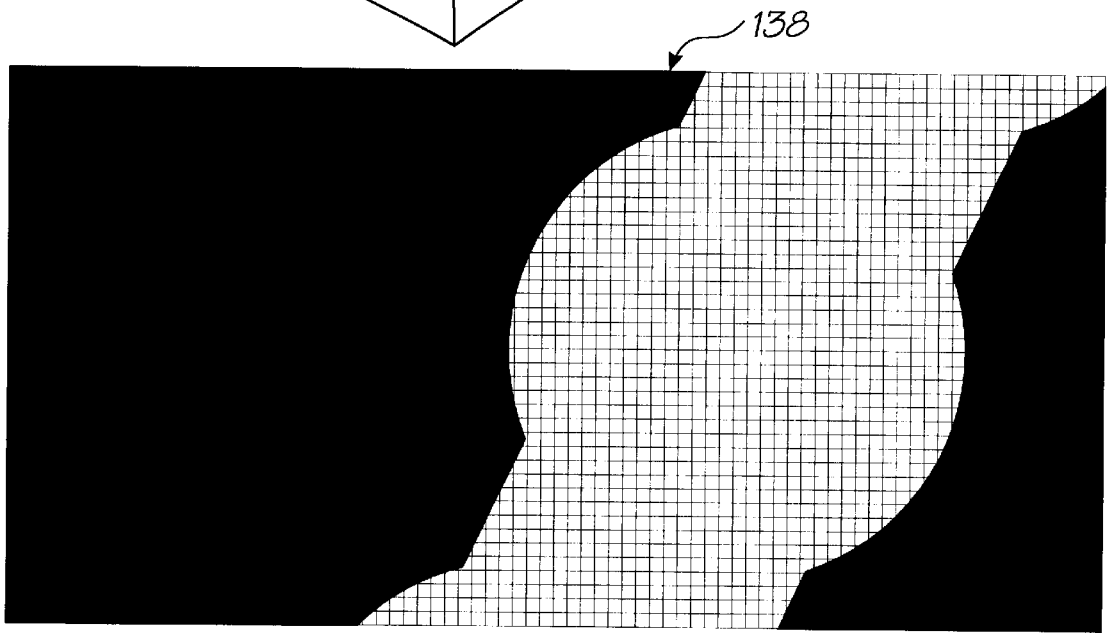
FIG. 47 illustrates a plan view of the back etch mask.
Figure 48:
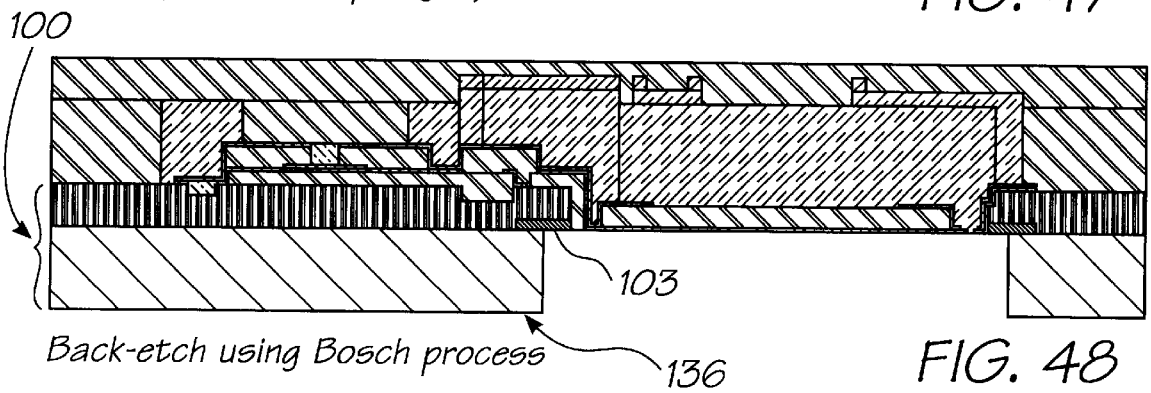
FIG. 48 illustrates a side plan view, partly in section, of the preferred embodiment with the back etch Layer.

12. As shown in FIG. 46 to FIG. 48, the wafer 100 is thinned to 300 microns (to reduce back-etch time), and 3 microns of resist (not shown) on the back-side 136 of the wafer 100 is exposed through the mask 138 of FIG. 47. Alignment is to metal portions 103 on the front side of the wafer 100. This alignment can be achieved using an IR microscope attachment to the wafer aligner.

The wafer 100 is then etched (from the back-side 136) to a depth of 330 microns (allowing 10% over-etch) using the deep silicon etch "Bosch process". This process is available on plasma etchers from Alcatel, Plasma-therm, and Surface Technology Systems. The chips are also diced by this etch, but the wafer is still held together by 11 microns of the various polyimide layers.

Figure 49:
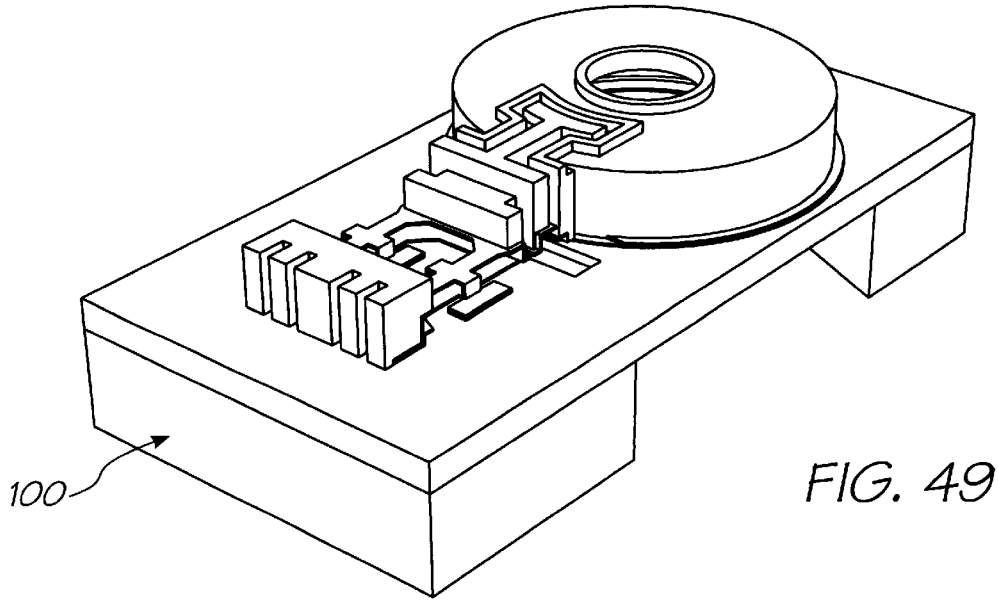
FIG. 49 illustrates a side perspective view of the preferred embodiment with the stripping sacrificial material Layer.
Figure 50:
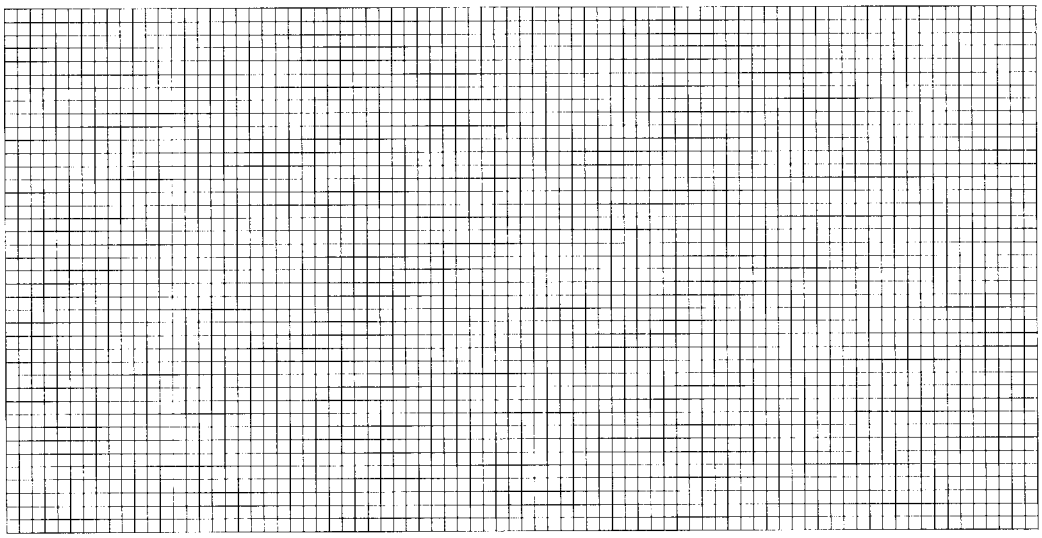
FIG. 50 illustrates a plan view of the stripping sacrificial material mask.
Figure 51:
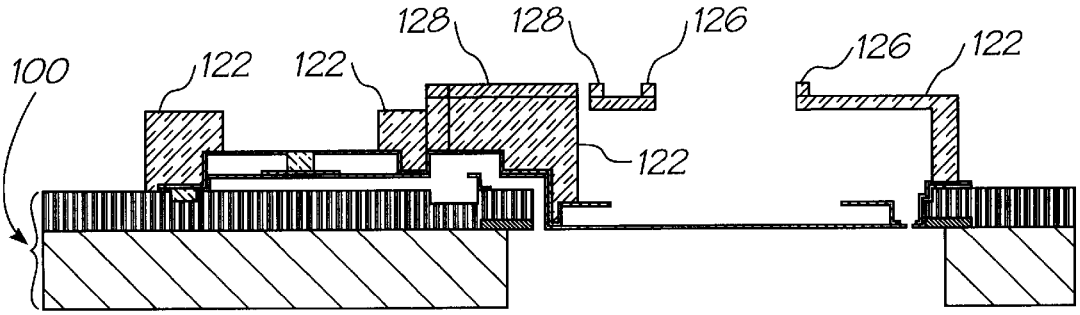
FIG. 51 illustrates a side plan view, partly in section, of the preferred embodiment with the stripping sacrificial material Layer.
Figure 60:
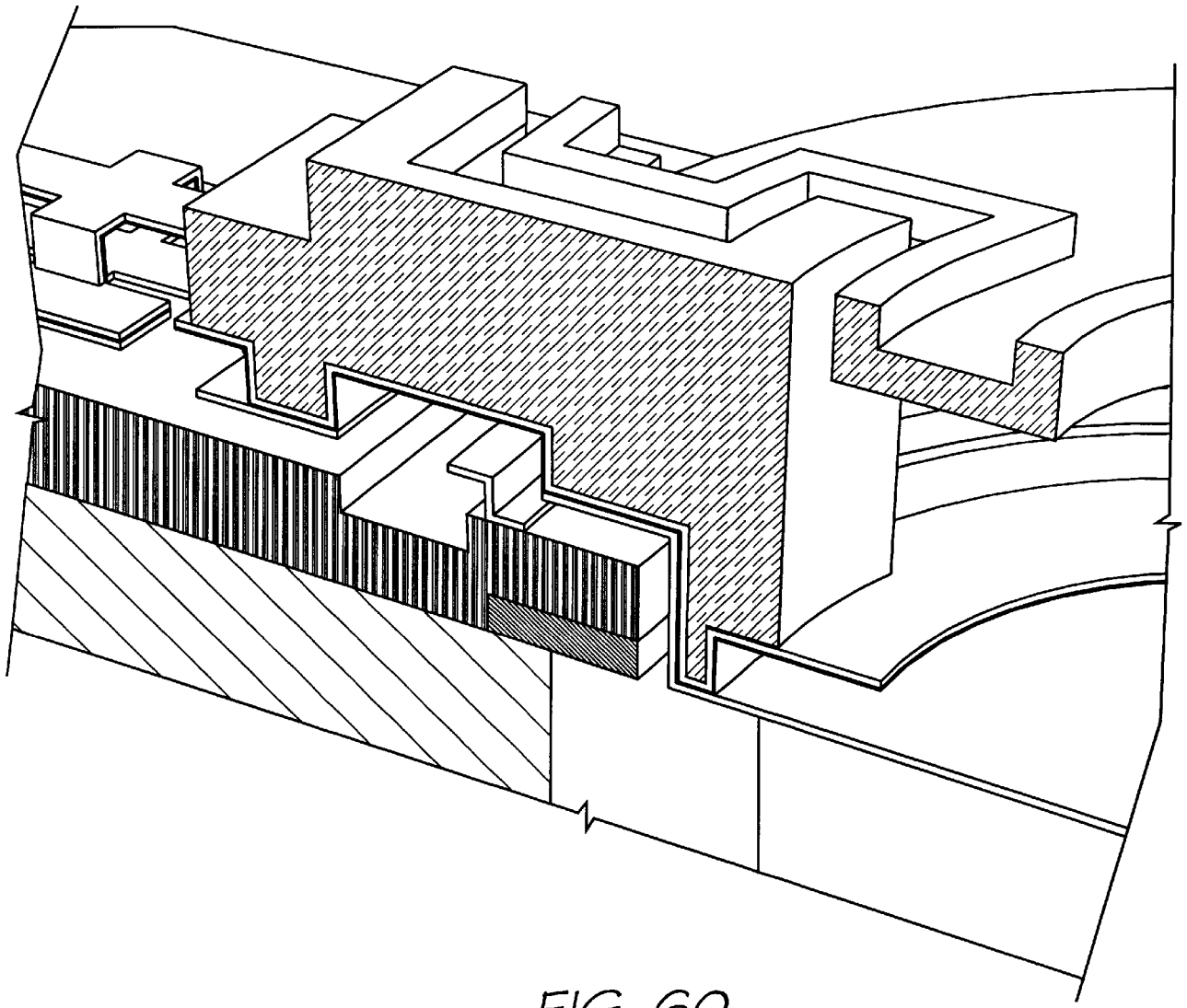
FIG. 60 illustrates an enlarged side perspective view showing the actuator arm and nozzle chamber.
Figure 61:
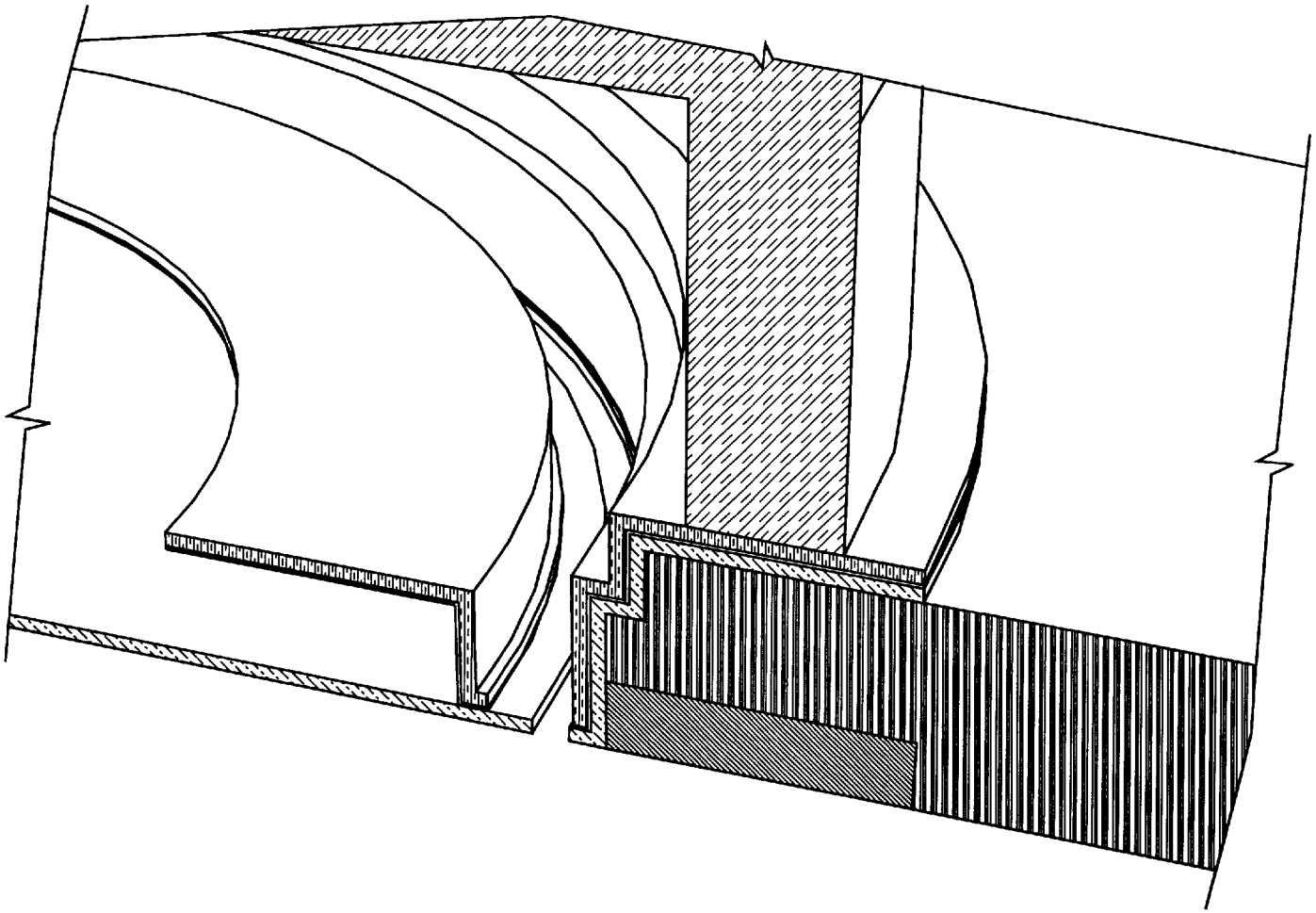
FIG. 61 illustrates an enlarged side perspective view showing the actuator paddle rim and nozzle chamber.
Figure 62:
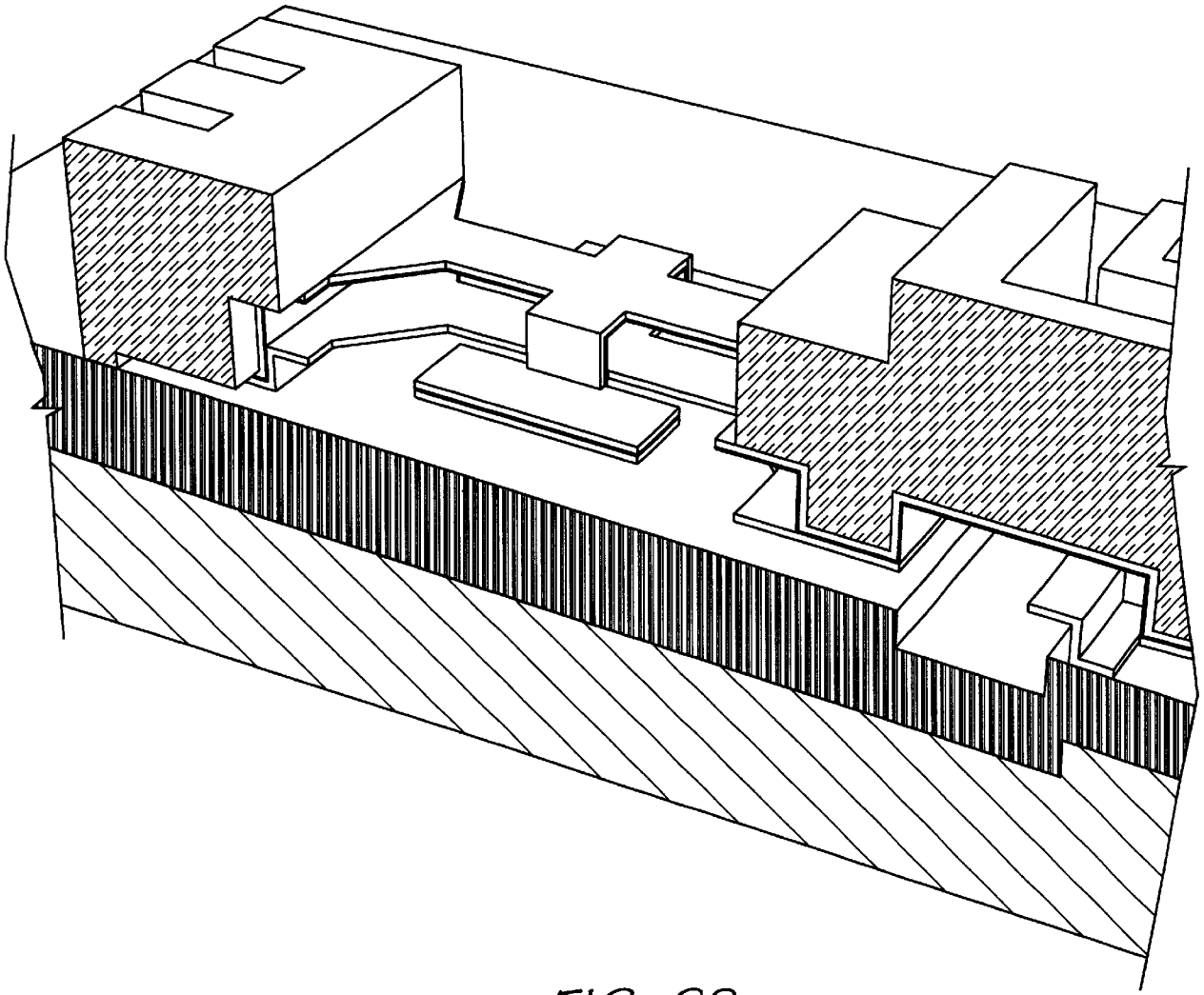
FIG. 62 illustrates an enlarged side perspective view showing the actuator heater element.

13. As illustrated with reference to FIG. 49 to FIG. 51, the wafer 100 is turned over, placed in a tray, and all of the sacrificial polyimide layers 102, 110, 118 and 134 are etched in an oxygen plasma using no mask (FIG. 60).

Figure 52:
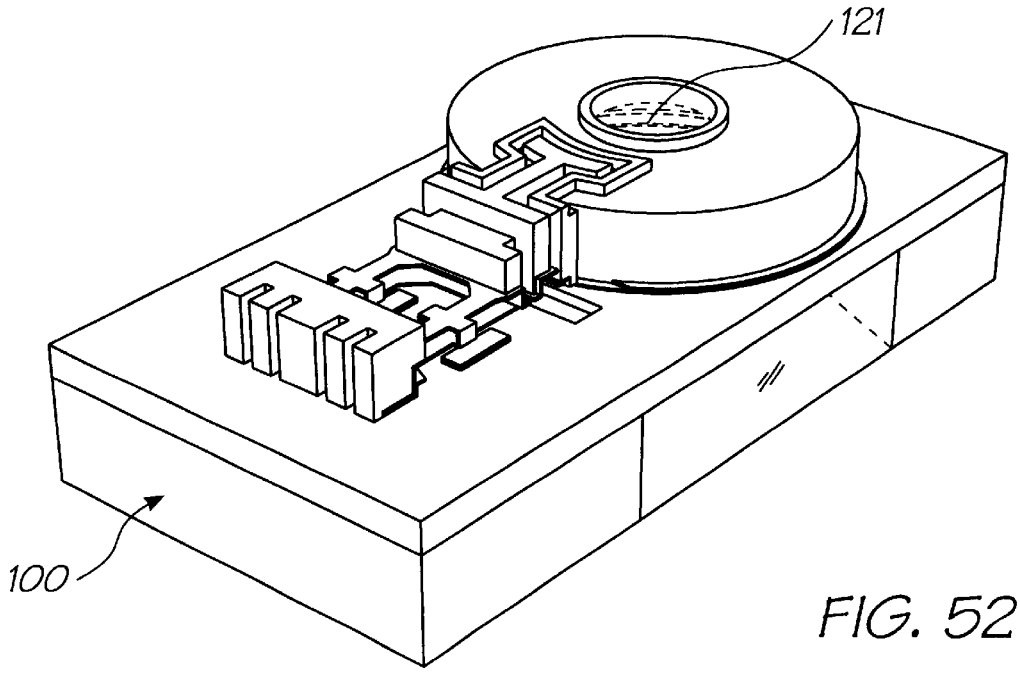
FIG. 52 illustrates a side perspective view of the preferred embodiment with the package, bond, prime and test.
Figure 53:
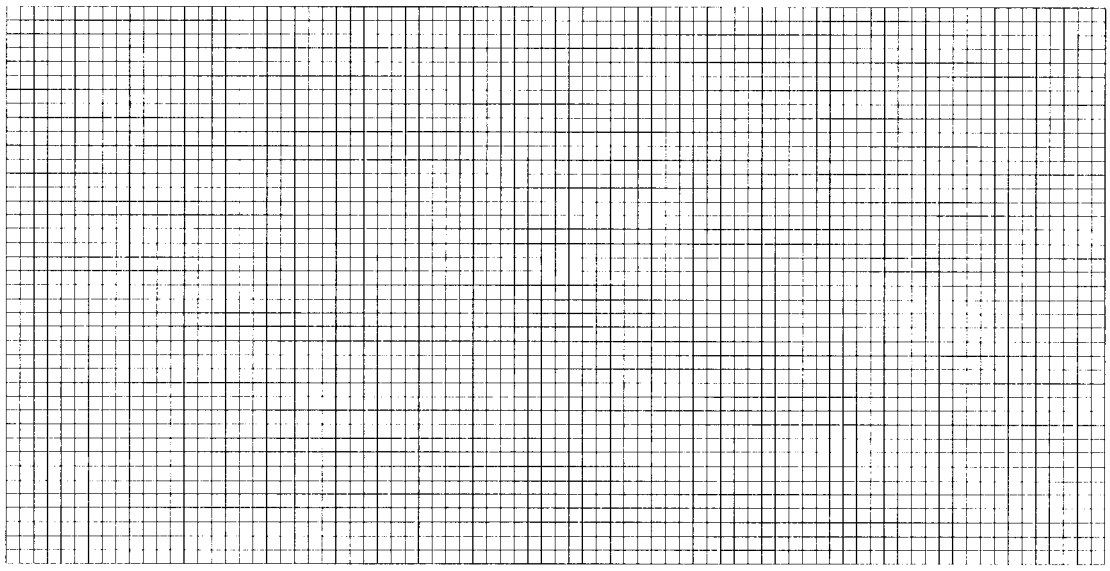
FIG. 53 illustrates a plan view of the package, bond, prime and test mask.
Figure 54:
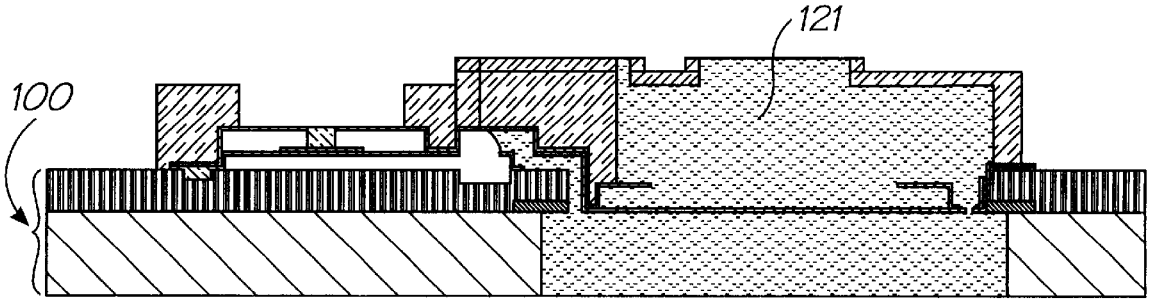
FIG. 54 illustrates a side plan view, partly in section, of the preferred embodiment with the package, bond, prime and test.
Figure 55:
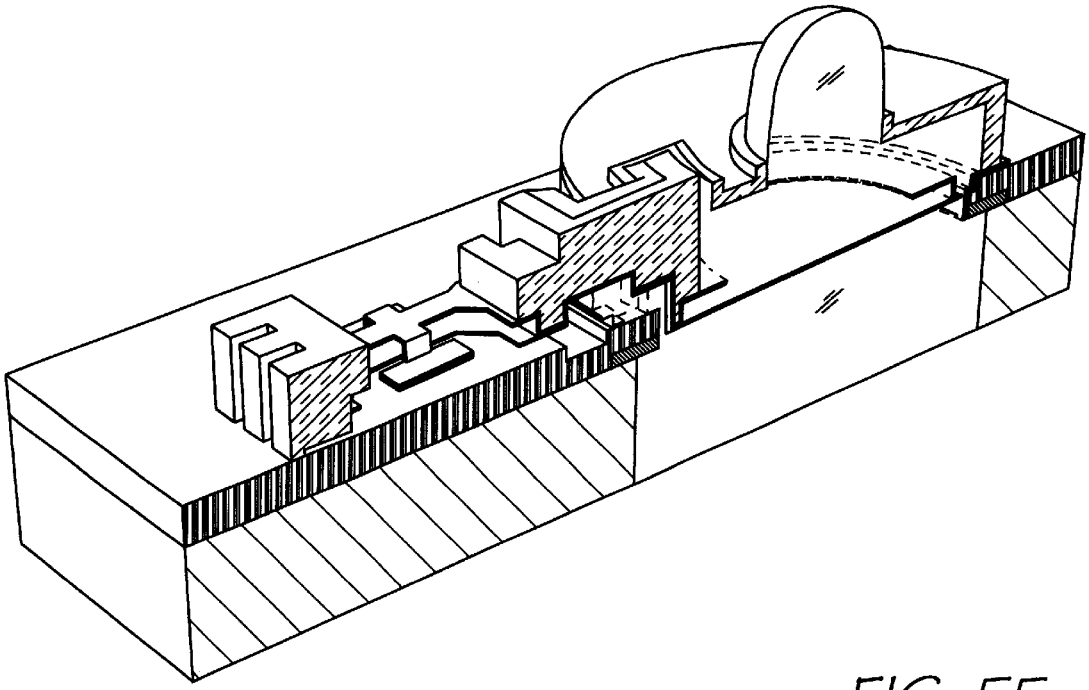
FIG. 55 illustrates a side perspective view in section of the preferred embodiment ejecting a drop.

14. As illustrated with reference to FIG. 52 to FIG. 54, a package is prepared by drilling a 0.5 mm hold in a standard package, and gluing an ink hose (not shown) to the package. The ink hose should include a 0.5 micron absolute filter to prevent contamination of the nozzles from the ink 121.

FIGS. 55 to 62 illustrate various views of the preferred embodiment, some illustrating the embodiments in operation.

Figure 56:
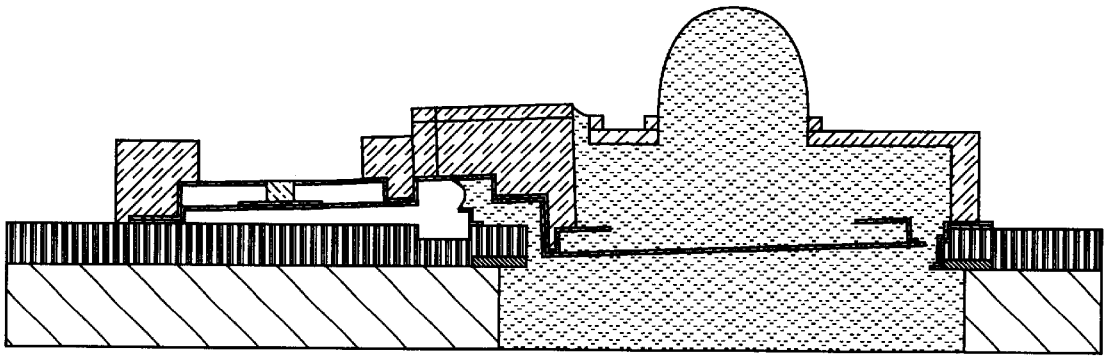
FIG. 56 illustrates a side perspective view of the preferred embodiment when actuating.
Figure 57:
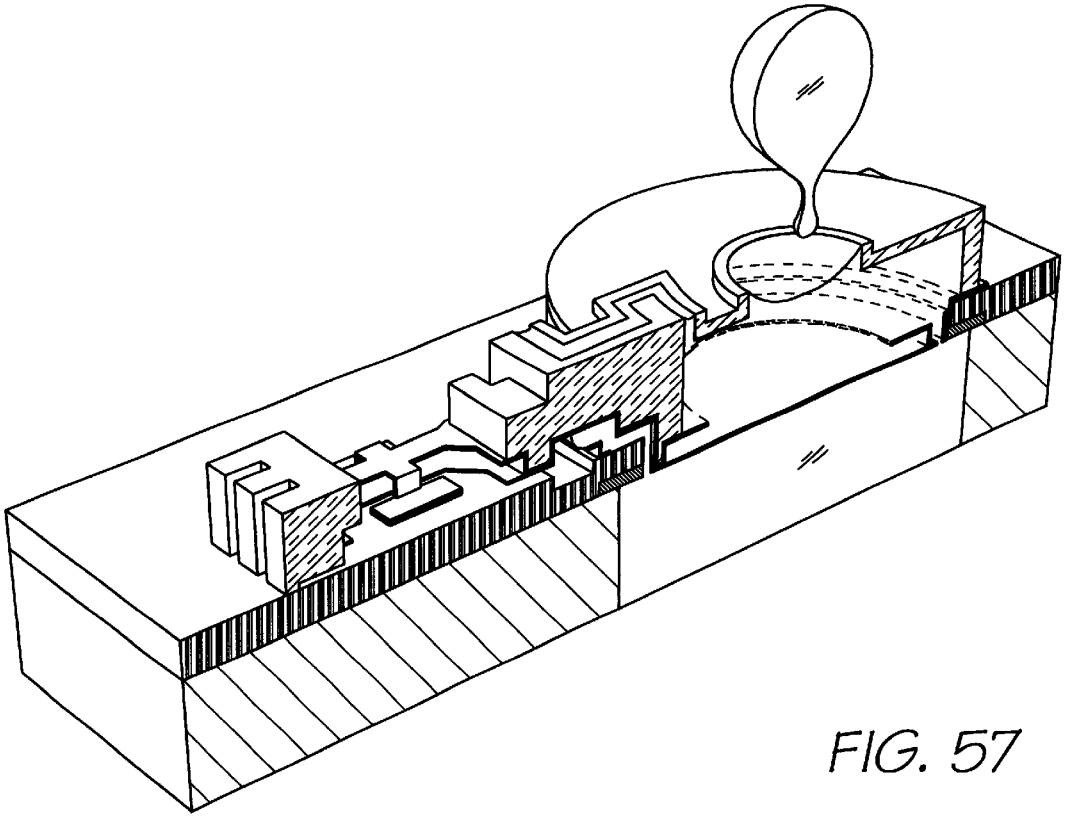
FIG. 57 illustrates a side perspective view in section of the preferred embodiment ejecting a drop.
Figure 58:
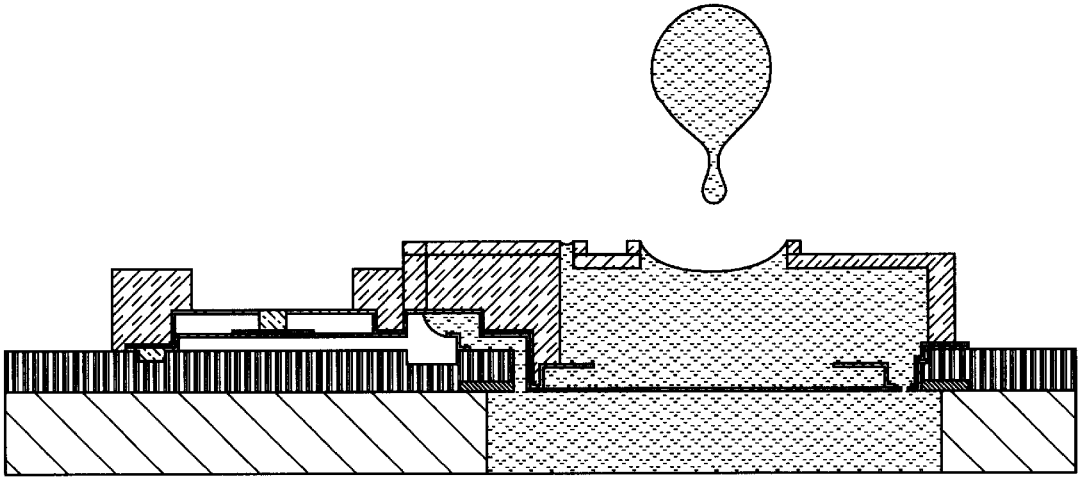
FIG. 58 illustrates a side plan view, partly in section, of the preferred embodiment when returning.
Figure 59:
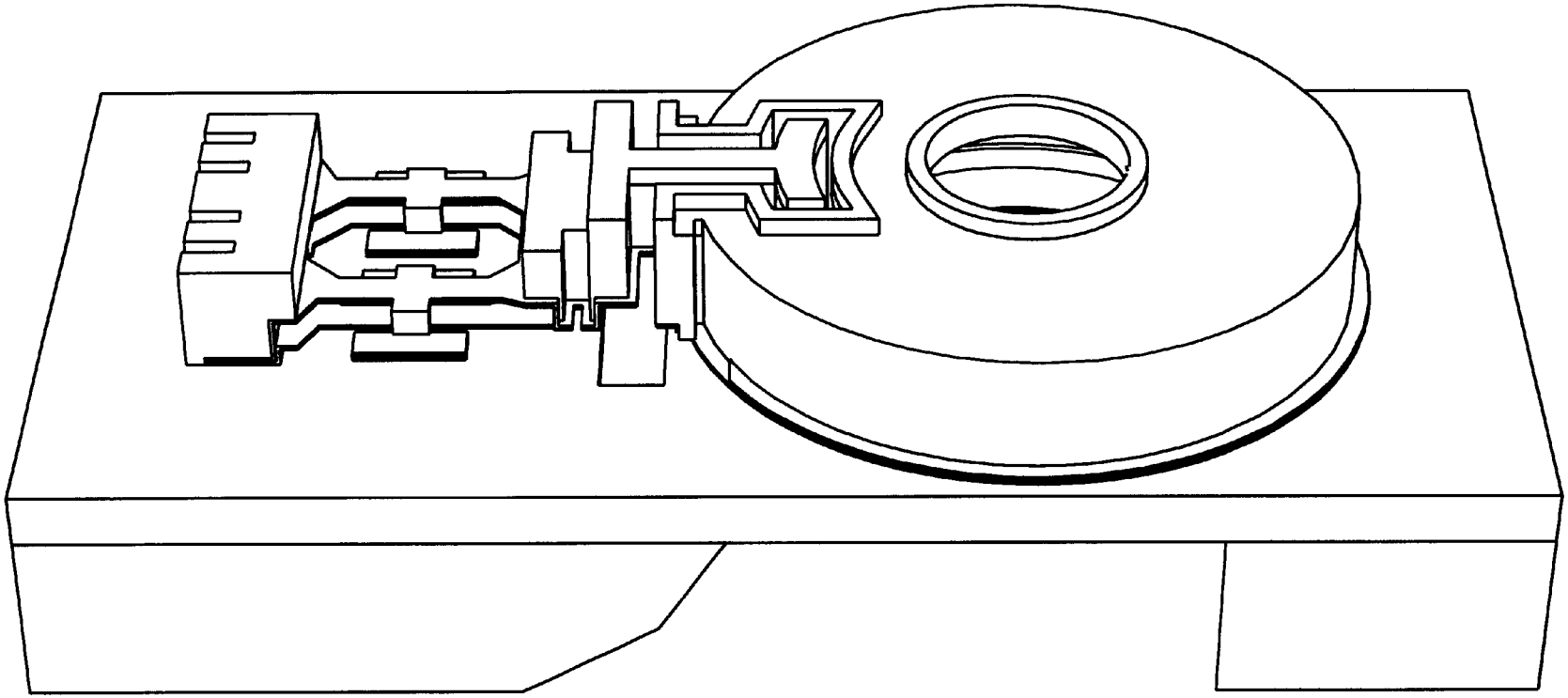
FIG. 59 illustrates a top plan view of the preferred embodiment.
Figure 63:
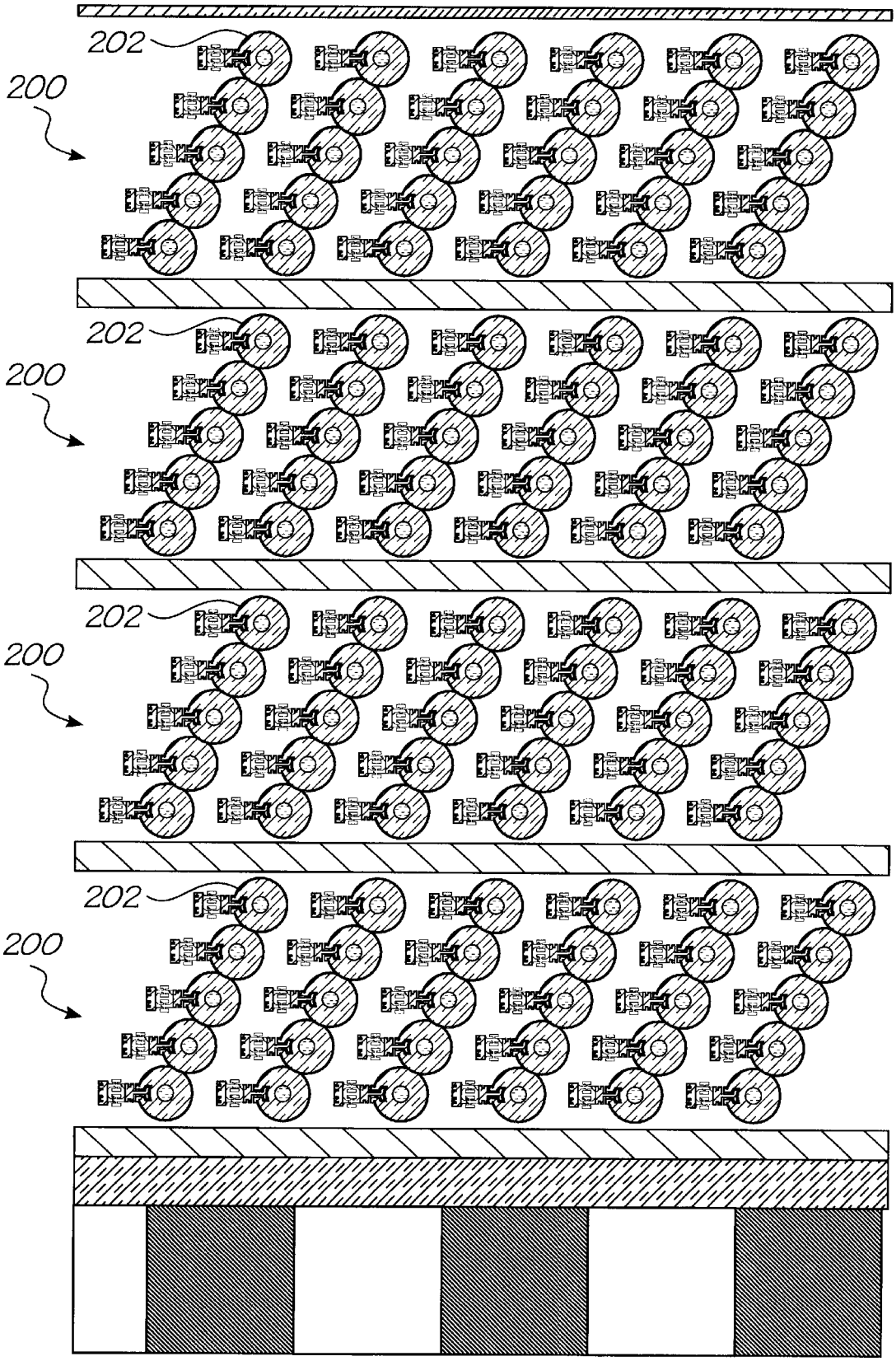
FIG. 63 illustrates a top plan view of an array of nozzles formed on a wafer.
Figure 64:
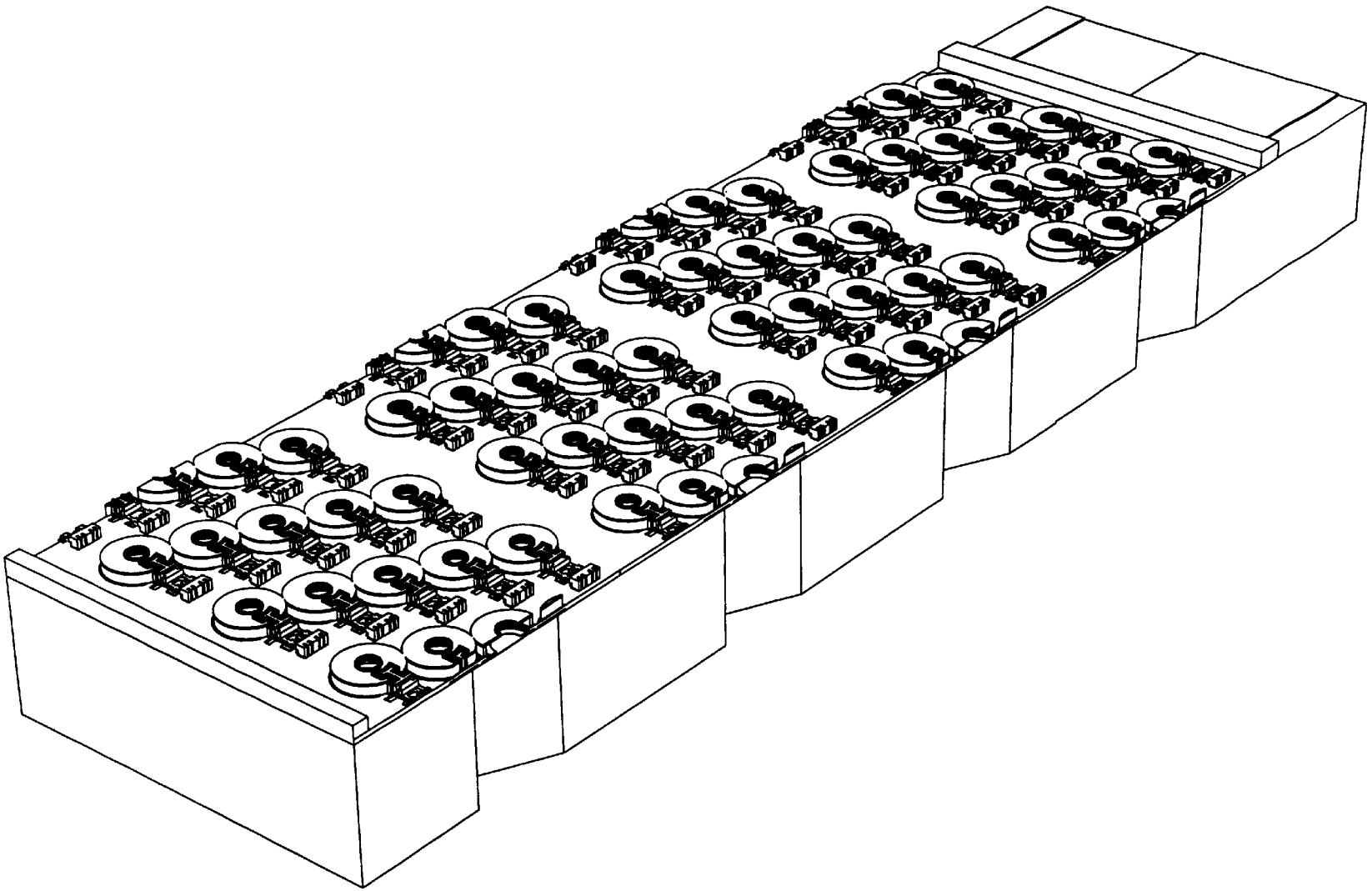
FIG. 64 illustrates a side perspective view in section of an array of nozzles formed on a wafer.
Figure 65:
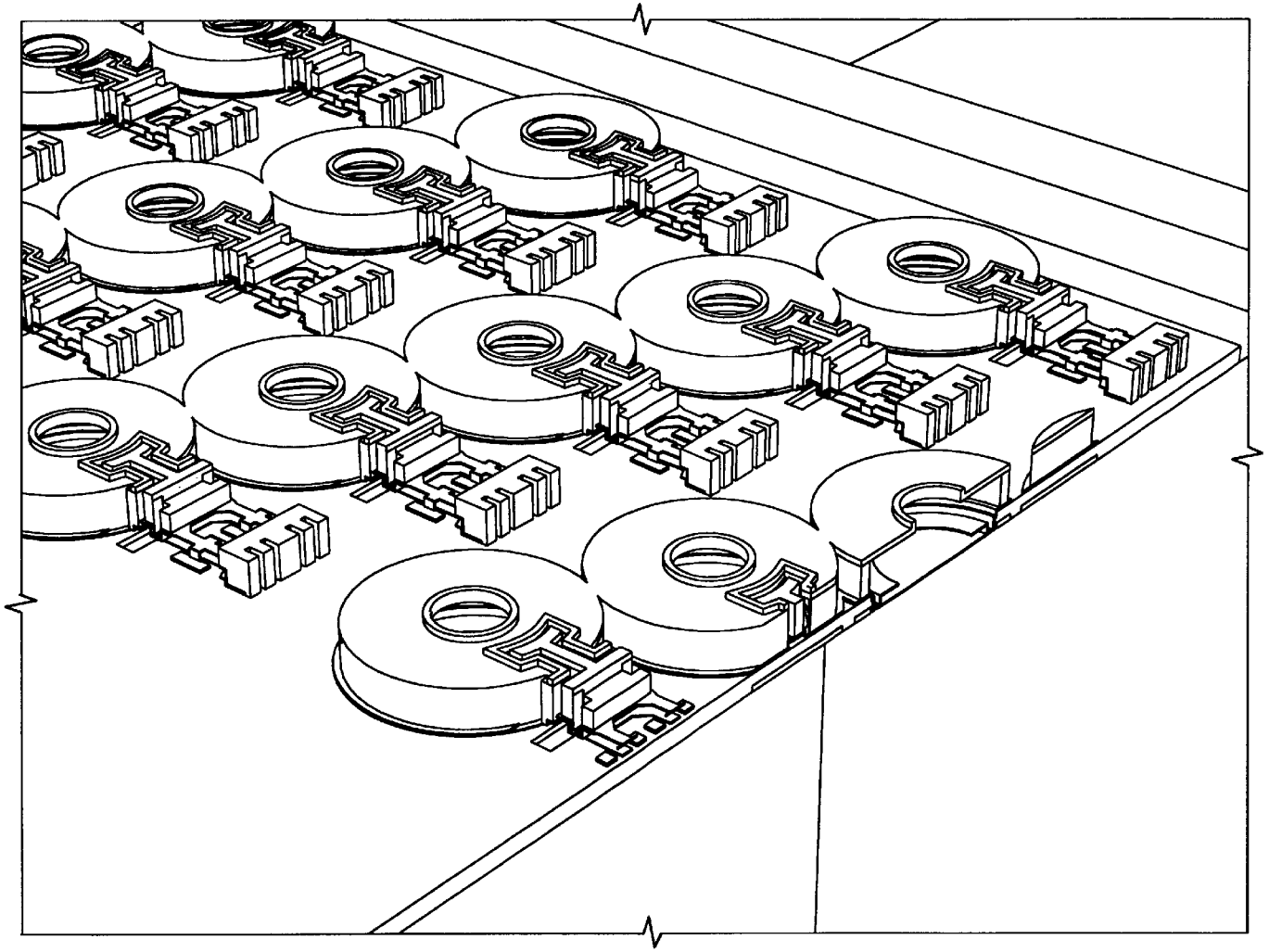
FIG. 65 illustrates an enlarged side perspective view in section of an array of nozzles formed on a wafer.

Obviously, large arrays 200 of print heads 202 can be simultaneously constructed as illustrated in FIG. 63 to FIG. 56 which illustrate various print head array views. The presently disclosed ink jet printing technology is potentially suited to a wide range of printing systems including: colour and monochrome office printers, short run digital printers, high speed digital printers, offset press supplemental printers, low cost scanning printers, high speed pagewidth printers, notebook computers with in-built pagewidth printers, portable colour and monochrome printers, colour and monochrome copiers, colour and monochrome facsimile machines, combined printer, facsimile and copying machines, label printers, large format plotters, photograph copiers, printers for digital photographic 'minilabs', video printers, PhotoCD printers, portable printers for PDAs, wallpaper printers, indoor sign printers, billboard printers, fabric printers, camera printers and fault tolerant commercial printer arrays.

Further, the MEMS principles outlined have general applicability in the construction of MEMS devices.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

What is claimed is:

1. A liquid ejection device comprising:

a nozzle chamber, an ejection paddle located within the nozzle chamber for ejecting liquid from the nozzle chamber though an aperture in one wall of the nozzle chamber when the paddle is moved from a first state into an ejection state, a liquid supply port arranged in a manner such that it is substantially closed by the paddle when the paddle is in the first state;

wherein the nozzle chamber comprises an internal protrusion on a wall structure thereof which is aligned closely adjacent to a rim of the paddle when the paddle is in the first state, and wherein, in the ejection state, at least a portion of the rim of the paddle is spaced apart from the protrusion, thereby forming a liquid refill channel defined between the wall structure and the portion of the rim of the paddle.

2. A device as claimed in claim 1, wherein the internal protrusion may have a staircase-type cross-sectional profile.

3. A device as claimed in claim 1, wherein the paddle and the internal protrusion are formed in one deposition step.

4. A device as claimed in claim 1, wherein the internal protrusion is formed using a lower aspect ratio deposition step when compared to a high aspect ratio deposition step for forming the wall structure of the nozzle chamber.

5. A device as claimed in claim 1, wherein the paddle is substantially planar.

* * * * *